US010102862B2

(12) United States Patent
Wang et al.

(10) Patent No.: US 10,102,862 B2
(45) Date of Patent: Oct. 16, 2018

(54) DECODING METHOD AND DECODER FOR AUDIO SIGNAL ACCORDING TO GAIN GRADIENT

(71) Applicant: HUAWEI TECHNOLOGIES CO., LTD., Shenzhen, Guangdong (CN)

(72) Inventors: Bin Wang, Beijing (CN); Lei Miao, Beijing (CN); Zexin Liu, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 14/985,831

(22) Filed: Dec. 31, 2015

(65) Prior Publication Data

US 2016/0118055 A1 Apr. 28, 2016

Related U.S. Application Data

(63) Continuation of application No. PCT/CN2014/077096, filed on May 9, 2014.

(30) Foreign Application Priority Data

Jul. 16, 2013 (CN) ..... 2013 1 0298040

(51) Int. Cl.
*G10L 19/00* (2013.01)
*G10L 19/005* (2013.01)
(Continued)

(52) U.S. Cl.
CPC ..... *G10L 19/005* (2013.01); *G10L 19/0208* (2013.01); *G10L 21/0232* (2013.01); *G10L 21/0388* (2013.01)

(58) Field of Classification Search
CPC ..... G10L 19/005
(Continued)

(56) References Cited

U.S. PATENT DOCUMENTS 5,946,651 A * 8/1999 Jarvinen ..... G10L 19/26 704/208
7,146,309 B1 12/2006 Benyassine et al.
(Continued)

FOREIGN PATENT DOCUMENTS

CN 1732512 A 2/2006
CN 1989548 A 6/2007
(Continued)

OTHER PUBLICATIONS

"Enhanced Variable Rate Codec, Speech Service Options 3, 68, 70, 73 and 77 for Wideband Spread Spectrum Digital Systems",3GPP2 Standard; C.S0014-E, V1.0, Dec. 2011, total 358 pages.
(Continued)

*Primary Examiner* — Shaun Roberts
(74) *Attorney, Agent, or Firm* — Huawei Technologies Co., Ltd.

(57) ABSTRACT

Embodiments of the present disclosure provide a decoding method and a decoding apparatus. The decoding method includes: in a case in which it is determined that a current frame is a lost frame, synthesizing a high frequency band signal; determining subframe gains of multiple subframes of the current frame; determining a global gain of the current frame; and adjusting, according to the global gain and the subframe gains of the multiple subframes, the synthesized high frequency band signal to obtain a high frequency band signal of the current frame. A subframe gain of the current frame is obtained according to a gradient between subframe gains of subframes previous to the current frame, so that transition before and after frame loss is more continuous, thereby reducing noise during signal reconstruction, and improving speech quality.

10 Claims, 8 Drawing Sheets

(51) Int. Cl.
*G10L 19/02* (2013.01)
*G10L 21/0232* (2013.01)
*G10L 21/0388* (2013.01)

(58) Field of Classification Search
USPC ..... 704/205, 208, 500
See application file for complete search history.

(56) References Cited

U.S. PATENT DOCUMENTS

| | | | | |
|---|---|---|---|---|
| 7,454,330 | B1 | 11/2008 | Nishiguchi et al. | |
| 7,693,710 | B2 | 4/2010 | Jelinek et al. | |
| 8,457,115 | B2 * | 6/2013 | Zhan | G10L 19/005 370/208 |
| 8,744,843 | B2 * | 6/2014 | Geiger | 704/201 |
| 2004/0107090 | A1 * | 6/2004 | Oh | G10L 21/038 704/201 |
| 2004/0128128 | A1 * | 7/2004 | Wang | G10L 19/005 704/229 |
| 2005/0154584 | A1 | 7/2005 | Jelinek et al. | |
| 2008/0040120 | A1 * | 2/2008 | Kurniawati | G10L 19/002 704/500 |
| 2008/0046233 | A1 * | 2/2008 | Chen | G10L 19/005 704/211 |
| 2008/0071530 | A1 | 3/2008 | Ehara | |
| 2009/0119098 | A1 | 5/2009 | Zhan et al. | |
| 2009/0141790 | A1 * | 6/2009 | Kawashima | G10L 19/24 375/240 |
| 2009/0182558 | A1 | 7/2009 | Su et al. | |
| 2009/0210237 | A1 | 8/2009 | Shen et al. | |
| 2009/0248404 | A1 | 10/2009 | Ehara et al. | |
| 2009/0316598 | A1 | 12/2009 | Zhan et al. | |
| 2010/0057447 | A1 | 3/2010 | Ehara | |
| 2011/0022924 | A1 | 1/2011 | Malenovsky | |
| 2011/0044323 | A1 | 2/2011 | Zhan et al. | |
| 2011/0082693 | A1 | 4/2011 | Krishnan et al. | |
| 2011/0137659 | A1 | 6/2011 | Honma et al. | |
| 2012/0010882 | A1 | 1/2012 | Thyssen et al. | |
| 2012/0253797 | A1 | 10/2012 | Geiger et al. | |
| 2012/0323567 | A1 * | 12/2012 | Gao | G10L 19/005 704/201 |
| 2016/0118055 | A1 | 4/2016 | Wang et al. | |

FOREIGN PATENT DOCUMENTS

| | | | |
|---|---|---|---|
| CN | 100338648 | C | 9/2007 |
| CN | 101583995 | A | 11/2009 |
| CN | 101836254 | A | 9/2010 |
| CN | 102169692 | A | 8/2011 |
| CN | 102915737 | A | 2/2013 |
| JP | 2010-530078 | A | 9/2010 |
| KR | 101800710 | B1 | 11/2017 |
| RU | 2233010 | C2 | 7/2004 |

OTHER PUBLICATIONS

"Digital terminal equipments—Coding of voice and audio signals, 7 kHz audio-coding within 64 kbit/s", Recommendation ITU-T G122, Sep. 2012, total 274 pages.

Jang Y. K. et al: "Pitch Detection and Estimation Using Adaptive IIR Comb Filtering", Dec. 1992, total 6 pages.

"3rd Generation Partnership Project; Technical Specification Group Services and System Aspects; Codec for Enhanced Voice Services EVS Codec Error Concealment of Lost Packets (Release 12)", 3GPP TS 26.447 V0.0.1, May 2004, total 77 pages.

"Initial Version of TS 26.447—EVS Codec Error Concealment of Lost Packets", S4-140829, Aug. 2014, total 1 page.

Toshiyuki Sakai, et al."Review of a packet loss compensation method of real-time music distribution using MP3"Collection of Papers of Spring Meeting 2006 by the Acoustical Society of Japan.Mar. 7, 2006, pp. 523-524.with English translation.

Choong Sang Cho et al: "A Packet Loss Concealment Algorithm Robust to Burst Packet Loss for CELP-type Speech Coders", ITC CSCC:International Technical Conference on Circuits Systems, Computers and Communications, Jul. 1, 2008 (Jul. 1, 2008), pp. 941-944, XP055185306.

* cited by examiner

DECODING METHOD AND DECODER FOR AUDIO SIGNAL ACCORDING TO GAIN GRADIENT

CROSS-REFERENCE TO RELATED APPLICATION

This application is a continuation of International Application No. PCT/CN2014/077096, filed on May 9, 2014, which claims priority to Chinese Patent Application No. 201310298040.4, filed on Jul. 16, 2013, both of which are hereby incorporated by reference in their entireties.

TECHNICAL FIELD

The present disclosure relates to the field of coding and decoding, and in particular, to a decoding method and a decoding apparatus.

BACKGROUND

There is a demand for increased voice quality in communications technology. Increasing voice bandwidth is one method of improving voice quality. Generally, bandwidth is increased by using a bandwidth extension technology, and the bandwidth extension technology includes a time domain bandwidth extension technology and a frequency domain bandwidth extension technology.

In the time domain bandwidth extension technology, a packet loss rate is a key factor that affects signal quality. In a case of packet loss, a lost frame needs to be restored as accurately as possible. A decoder side determines, by parsing bitstream information, whether frame loss occurs. If frame loss does not occur, normal decoding processing is performed. If frame loss occurs, frame loss processing needs to be performed.

When frame loss processing is performed, the decoder side obtains a high frequency band signal according to a decoding result of a previous frame, and performs gain adjustment on the high frequency band signal by using a set subframe gain and a global gain that is obtained by multiplying a global gain of the previous frame by a fixed attenuation factor, to obtain a final high frequency band signal.

The subframe gain used during frame loss processing is a set value, and therefore a spectral discontinuity phenomenon may occur, resulting in that transition before and after frame loss is discontinuous, a noise phenomenon appears during signal reconstruction, and speech quality deteriorates.

SUMMARY

Embodiments of the present disclosure provide a decoding method and a decoding apparatus, which can prevent or reduce a noise phenomenon during frame loss processing, thereby improving speech quality.

In one embodiment of the present disclosure a decoding method for a current frame that is a lost frame is disclosed that includes synthesizing a high frequency band signal according to a decoding result of a previous frame of the current frame, determining subframe gains of at least two subframes of the current frame according to subframe gains of subframes of at least one frame previous to the current frame and a gain gradient between the subframes of the at least one frame, and determining a global gain of the current frame. This method also includes adjusting, according to the global gain and the subframe gains of the at least two subframes, the synthesized high frequency band signal and obtaining, based upon the adjustment of the synthesized high frequency band signal, a high frequency band signal of the current frame.

In another embodiment, A decoding apparatus used when a current frame is a lost frame, that includes a generating module, conFigured to synthesize a high frequency band signal according to a decoding result of a previous frame of the current frame, a determining module, conFigured to determine subframe gains of at least two subframes of the current frame according to subframe gains of subframes of at least one frame previous to the current frame and a gain gradient between the subframes of the at least one frame, and determine a global gain of the current frame, and an adjusting module, conFigured to adjust, according to the global gain and the subframe gains of the at least two subframes that are determined by the determining module, the high frequency band signal synthesized by the generating module, to obtain a high frequency band signal of the current frame.

In yet another embodiment a decoding apparatus, comprising a generating module, conFigured to in a case in which it is determined that a current frame is a lost frame, synthesize a high frequency band signal according to a decoding result of a previous frame of the current frame, a determining module, conFigured to determine subframe gains of at least two subframes of the current frame, estimate a global gain gradient of the current frame according to a frame class of a last frame received before the current frame and a quantity of consecutive lost frames previous to the current frame, and estimate a global gain of the current frame according to the global gain gradient and a global gain of the previous frame of the current frame, and an adjusting module, conFigured to adjust, according to the global gain and the subframe gains of the at least two subframes that are determined by the determining module, the high frequency band signal synthesized by the generating module, to obtain a high frequency band signal of the current frame.

BRIEF DESCRIPTION OF DRAWINGS

To describe the technical solutions in the embodiments of the present disclosure more clearly, the following briefly introduces the accompanying drawings required for describing the embodiments of the present disclosure. Apparently, the accompanying drawings in the following description show merely some embodiments of the present disclosure, and a person of ordinary skill in the art may still derive other drawings from these accompanying drawings without creative efforts.

DESCRIPTION OF EMBODIMENTS

Figure 1:
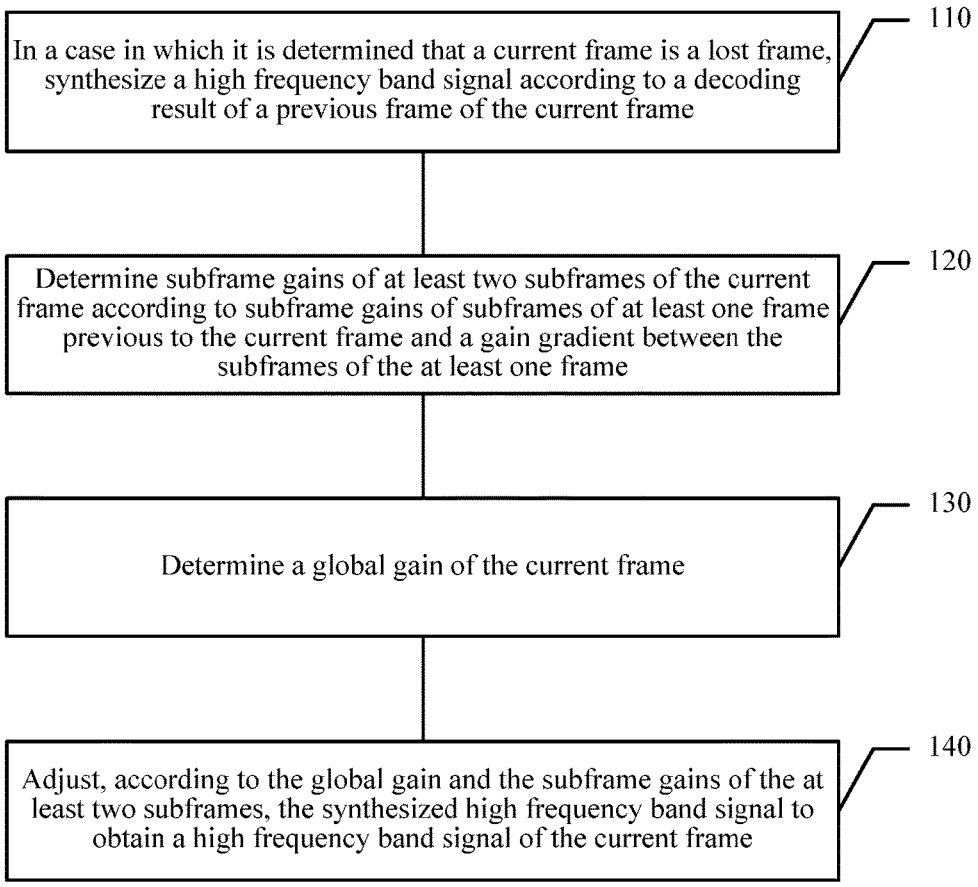
FIG. 1 is a schematic flowchart of a decoding method according to an embodiment of the present disclosure.

The following clearly and completely describes the technical solutions in the embodiments of the present disclosure with reference to the accompanying drawings in the embodiments of the present disclosure. Apparently, the described embodiments are some but not all of the embodiments of the present disclosure. All other embodiments obtained by a person of ordinary skill in the art based on the embodiments of the present disclosure without creative efforts shall fall within the protection scope of the present disclosure.

To reduce operation complexity and a processing delay of a codec during speech signal processing, generally frame division processing is performed whereby a speech signal is divided into multiple frames. When speech occurs, vibration of the glottis has a specific frequency (which corresponds to a pitch period). In a case of a relatively short pitch period, if a frame is excessively long, multiple pitch periods may exist within one frame, and the pitch periods are incorrectly calculated; therefore, one frame may be divided into multiple subframes.

In a time domain bandwidth extension technology, during coding, firstly, a core coder codes low frequency band information of a signal, to obtain parameters such as a pitch period, an algebraic codebook, and a respective gain, and performs Linear Predictive Coding (LPC) analysis on high frequency band information of the signal, to obtain a high frequency band LPC parameter, thereby obtaining an LPC synthesis filter; secondly, the core coder obtains a high frequency band excitation signal through calculation based on the parameters such as the pitch period, the algebraic codebook, and the respective gain, and synthesizes a high frequency band signal from the high frequency band excitation signal by using the LPC synthesis filter; then, the core coder compares an original high frequency band signal with the synthesized high frequency band signal, to obtain a subframe gain and a global gain; and finally, the core coder converts the LPC parameter into a Linear Spectrum Frequency (LSF) parameter, and quantizes and codes the LSF parameter, the subframe gain, and the global gain.

During decoding, dequantization is performed on the LSF parameter, the subframe gain, and the global gain. The LSF parameter is converted into the LPC parameter, thereby obtaining the LPC synthesis filter. The parameters such as the pitch period, the algebraic codebook, and the respective gain are obtained by using the core decoder, the high frequency band excitation signal is obtained based on the parameters such as the pitch period, the algebraic codebook, and the respective gain, and the high frequency band signal is synthesized from the high frequency band excitation signal by using the LPC synthesis filter, and finally gain adjustment is performed on the high frequency band signal according to the subframe gain and the global gain, to recover the high frequency band signal of a lost frame.

According to one embodiment of the present disclosure it may be determined by parsing bitstream information whether frame loss occurs in the current frame. If frame loss does not occur in the current frame, the foregoing normal decoding process is performed. If frame loss occurs in the current frame, (e.g., the current frame is a lost frame) frame loss processing needs to be performed, that is, the lost frame needs to be recovered.

FIG. 1 is a schematic flowchart of a decoding method according to an embodiment of the present disclosure. The method in FIG. 1 may be executed by a decoder, and includes the following steps:

In block 110 of FIG. 1, in a case in which it is determined that a current frame is a lost frame, synthesize a high frequency band signal according to a decoding result of a previous frame of the current frame. For example, a decoder side determines, by parsing bitstream information, whether frame loss occurs. If frame loss does not occur, normal decoding processing is performed. If frame loss occurs, frame loss processing is performed. During frame loss processing, firstly, a high frequency band excitation signal is generated according to a decoding parameter of the previous frame; secondly, an LPC parameter of the previous frame is duplicated and used as an LPC parameter of the current frame, thereby obtaining an LPC synthesis filter; and finally, a synthesized high frequency band signal is obtained from the high frequency band excitation signal by using the LPC synthesis filter.

In block 120 of FIG. 1, there is a determination of subframe gains of at least two subframes of the current frame according to subframe gains of subframes of at least one frame previous to the current frame and a gain gradient between the subframes of the at least one frame. A subframe gain of a subframe may refer to a ratio of a difference between a synthesized high frequency band signal of the subframe and an original high frequency band signal to the synthesized high frequency band signal. For example, the subframe gain may refer to a ratio of a difference between an amplitude of the synthesized high frequency band signal of the subframe and an amplitude of the original high frequency band signal to the amplitude of the synthesized high frequency band signal. A gain gradient between subframes is used to indicate a change trend and degree, that is, a gain variation, of a subframe gain between adjacent subframes. For example, a gain gradient between a first subframe and a second subframe may refer to a difference between a subframe gain of the second subframe and a subframe gain of the first subframe. This embodiment of the present disclosure is not limited thereto. For example, the gain gradient between subframes may also refer to a subframe gain attenuation factor.

For example, a gain variation from a last subframe of a previous frame to a start subframe (which is a first subframe) of a current frame may be estimated according to a change trend and degree of a subframe gain between subframes of the previous frame, and a subframe gain of the start subframe of the current frame is estimated by using the gain variation and a subframe gain of the last subframe of the previous frame; then, a gain variation between subframes of the current frame may be estimated according to a change trend and degree of a subframe gain between subframes of at least one frame previous to the current frame; and finally, a subframe gain of another subframe of the current frame may be estimated by using the gain variation and the estimated subframe gain of the start subframe.

In block 130 of FIG. 1, there is a determination of a global gain of the current frame. A global gain of a frame may refer to a ratio of a difference between a synthesized high frequency band signal of the frame and an original high frequency band signal to the synthesized high frequency band signal. For example, a global gain may indicate a ratio of a difference between an amplitude of the synthesized high frequency band signal and an amplitude of the original high frequency band signal to the amplitude of the synthesized high frequency band signal.

A global gain gradient is used to indicate a change trend and degree of a global gain between adjacent frames. A global gain gradient between a frame and another frame may refer to a difference between a global gain of the frame and a global gain of the another frame. This embodiment of the present disclosure is not limited thereto. For example, a global gain gradient between a frame and another frame may also refer to a global gain attenuation factor.

For example, a global gain of a current frame may be estimated by multiplying a global gain of a previous frame of the current frame by a fixed attenuation factor. Particularly, in this embodiment of the present disclosure, the global gain gradient may be determined according to a frame class of a last frame received before the current frame and a quantity of consecutive lost frames previous to the current frame, and the global gain of the current frame may be estimated according to the determined global gain gradient.

In block 140 of FIG. 1, there is an adjustment (or control), according to the global gain and the subframe gains of the at least two subframes, the synthesized high frequency band signal to obtain a high frequency band signal of the current frame.

For example, an amplitude of a high frequency band signal of a current frame may be adjusted according to a global gain, and an amplitude of a high frequency band signal of a subframe may be adjusted according to a subframe gain.

In this embodiment of the present disclosure, when it is determined that a current frame is a lost frame, subframe gains of subframes of the current frame are determined according to subframe gains of subframes previous to the current frame and a gain gradient between the subframes previous to the current frame, and a high frequency band signal is adjusted by using the determined subframe gains of the current frame. A subframe gain of the current frame is obtained according to a gradient (which is a change trend and degree) between subframe gains of subframes previous to the current frame, so that transition before and after frame loss is more continuous, thereby reducing noise during signal reconstruction, and improving speech quality.

According to this embodiment of the present disclosure, in block 120 of FIG. 1, a subframe gain of a start subframe of the current frame is determined according to the subframe gains of the subframes of the at least one frame and the gain gradient between the subframes of the at least one frame. A subframe gain of another subframe except for the start subframe in the at least two subframes is determined according to the subframe gain of the start subframe of the current frame and the gain gradient between the subframes of the at least one frame.

According to this embodiment of the present disclosure, in block 120 of FIG. 1, a first gain gradient between a last subframe of the previous frame of the current frame and the start subframe of the current frame is estimated according to a gain gradient between subframes of the previous frame of the current frame. The subframe gain of the start subframe of the current frame is estimated according to a subframe gain of the last subframe of the previous frame of the current frame and the first gain gradient; a gain gradient between the at least two subframes of the current frame is estimated according to the gain gradient between the subframes of the at least one frame. The subframe gain of the another subframe except for the start subframe in the at least two subframes is estimated according to the gain gradient between the at least two subframes of the current frame and the subframe gain of the start subframe of the current frame.

According to this embodiment of the present disclosure, a gain gradient between last two subframes of the previous frame may be used as an estimated value of the first gain gradient. This embodiment of the present disclosure is not limited thereto, and weighted averaging may be performed on gain gradients between multiple subframes of the previous frame, to obtain the estimated value of the first gain gradient.

For example, an estimated value of a gain gradient between two adjacent subframes of a current frame may be: a weighted average of a gain gradient between two subframes corresponding in position to the two adjacent subframes in a previous frame of the current frame and a gain gradient between two subframes corresponding in position to the two adjacent subframes in a previous frame of the previous frame of the current frame, or an estimated value of a gain gradient between two adjacent subframes of a current frame may be: a weighted average of gain gradients between several adjacent subframes previous to two adjacent subframes of a previous subframe.

For example, in a case in which a gain gradient between two subframes refers to a difference between gains of the two subframes, an estimated value of a subframe gain of a start subframe of a current frame may be the sum of a subframe gain of a last subframe of a previous frame and a first gain gradient. In a case in which a gain gradient between two subframes refers to a subframe gain attenuation factor between the two subframes, a subframe gain of a start subframe of a current frame may be the product of a subframe gain of a last subframe of a previous frame and a first gain gradient.

In block 120 of FIG. 1, a weighted averaging is performed on a gain gradient between at least two subframes of the previous frame of the current frame, to obtain the first gain gradient, where when the weighted averaging is performed, a gain gradient between subframes of the previous frame of the current frame that are closer to the current frame occupies a larger weight; and the subframe gain of the start subframe of the current frame is estimated according to the subframe gain of the last subframe of the previous frame of the current frame and the first gain gradient, and the type (or referred to as a frame class of a last normal frame) of the last frame received before the current frame and the quantity of consecutive lost frames previous to the current frame.

For example, in a case in which a gain gradient between subframes of a previous frame is monotonically increasing or monotonically decreasing, weighted averaging may be performed on two gain gradients (a gain gradient between a third to last subframe and a second to last subframe and a gain gradient between the second to last subframe and a last subframe) between last three subframes in the previous frame, to obtain a first gain gradient. In a case in which a gain gradient between subframes of a previous frame is neither monotonically increasing nor monotonically decreasing, weighted averaging may be performed on a gain gradient between all adjacent subframes in the previous frame. Two adjacent subframes previous to a current frame that are closer to the current frame indicate a stronger correlation between a speech signal transmitted in the two adjacent subframes and a speech signal transmitted in the current frame. In this case, the gain gradient between the adjacent subframes may be closer to an actual value of the first gain gradient. Therefore, when the first gain gradient is estimated, a weight occupied by a gain gradient between subframes in the previous frame that are closer to the current frame may be set to a larger value. In this way, an estimated value of the first gain gradient may be closer to the actual value of the first gain gradient, so that transition before and after frame loss is more continuous, thereby improving speech quality.

According to this embodiment of the present disclosure, in a process of estimating a subframe gain, the estimated gain may be adjusted according to the frame class of the last frame received before the current frame and the quantity of consecutive lost frames previous to the current frame. Specifically, a gain gradient between subframes of the current frame may be estimated first, and then subframe gains of all subframes of the current frame are estimated by using the gain gradient between the subframes, with reference to the subframe gain of the last subframe of the previous frame of the current frame, and with the frame class of the last normal frame previous to the current frame and the quantity of consecutive lost frames previous to the current frame as determining conditions.

For example, a frame class of a last frame received before a current frame may refer to a frame class of a closest normal frame (which is not a lost frame) that is previous to the current frame and is received by a decoder side. For example, it is assumed that a coder side sends four frames to a decoder side, where the decoder side correctly receives a first frame and a second frame, and a third frame and a fourth frame are lost, and then a last normal frame before frame loss may refer to the second frame. Generally, a frame type may include: (1) a frame (UNVOICED_CLAS frame) that has one of the following features: unvoiced, silence, noise, and voiced ending; (2) a frame (UNVOICED_TRANSITION frame) of transition from unvoiced sound to voiced sound, where the voiced sound is at the onset but is relatively weak; (3) a frame (VOICED_TRANSITION frame) of transition after the voiced sound, where a feature of the voiced sound is already very weak; (4) a frame (VOICED_CLAS frame) that has the feature of the voiced sound, where a frame previous to this frame is a voiced frame or a voiced onset frame; (5) an onset frame (ONSET frame) that has an obvious voiced sound; (6) an onset frame (SIN_ONSET frame) that has mixed harmonic and noise; and (7) a frame (INACTIVE_CLAS frame) that has an inactive feature.

The quantity of consecutive lost frames may refer to the quantity of consecutive lost frames after the last normal frame, or may refer to a ranking of a current lost frame in the consecutive lost frames. For example, a coder side sends five frames to a decoder side, the decoder side correctly receives a first frame and a second frame, and a third frame to a fifth frame are lost. If a current lost frame is the fourth frame, a quantity of consecutive lost frames is 2; or if a current lost frame is the fifth frame, a quantity of consecutive lost frames is 3

For example, in a case in which a frame class of a current frame (which is a lost frame) is the same as a frame class of a last frame received before the current frame and a quantity of consecutive current frames is less than or equal to a threshold (for example, 3), an estimated value of a gain gradient between subframes of the current frame is close to an actual value of a gain gradient between the subframes of the current frame; otherwise, the estimated value of the gain gradient between the subframes of the current frame is far from the actual value of the gain gradient between the subframes of the current frame. Therefore, the estimated gain gradient between the subframes of the current frame may be adjusted according to the frame class of the last frame received before the current frame and the quantity of consecutive current frames, so that the adjusted gain gradient between the subframes of the current frame is closer to the actual value of the gain gradient, so that transition before and after frame loss is more continuous, thereby improving speech quality.

For example, when a quantity of consecutive lost frames is less than a threshold, if a decoder side determines that a last normal frame is an onset frame of a voiced frame or an unvoiced frame, it may be determined that a current frame may also be a voiced frame or an unvoiced frame. In other words, it may be determined, by using a frame class of the last normal frame previous to the current frame and the quantity of consecutive lost frames previous to the current frame as determining conditions, whether a frame class of the current frame is the same as a frame class of a last frame received before the current frame; and if the frame class of the current frame is the same as the frame class of the last frame received before the current frame, a gain coefficient is adjusted to take a relatively large value; or if the frame class of the current frame is different from the frame class of the last frame received before the current frame, a gain coefficient is adjusted to take a relatively small value.

According to this embodiment of the present disclosure, when the previous frame of the current frame is an $(n-1)^{th}$ frame, the current frame is an $n^{th}$ frame, and each frame includes I subframes, the first gain gradient is obtained by using the following formula (1):

$$GainGradFEC[0] = \sum_{j=0}^{I-2} GainGrad[n-1, j] * \alpha_j, \tag{1}$$

where GrainGradFEC[0] is the first gain gradient, GrainGrad[n−1, j] is a gain gradient between a $j^{th}$ subframe and a $(j+1)^{th}$ subframe of the previous frame of the current frame, $\alpha_{j+1} \geq \alpha_j$, $$\sum_{j=0}^{I-2} \alpha_j = 1,$$

and j=0, 1, 2, . . . , 1-2;

where the subframe gain of the start subframe is obtained by using the following formulas (2) and (3):

$$GainShapeTemp[n,0]=GainShape[n-1,I-1]+\varphi_1*GainGradFEC[0]; \tag{2}$$

$$GainShape[n,0]=GainShapeTemp[n,0]*\varphi_2; \tag{3}$$

where GainShape[n−1,I−1] is a subframe gain of an $(I-1)^{th}$ subframe of the $(n-1)^{th}$ frame, GainShape[n,0] is the subframe gain of the start subframe of the current frame, GainShapeTemp[n,0] is a subframe gain intermediate value of the start subframe, $0 \leq \varphi_1 \leq 1.0$, $0 < \varphi_2 \leq 1.0$, $\varphi_1$ is determined by using a frame class of a last frame received before the current frame and a plus or minus sign of the first gain gradient, and $\varphi_2$ is determined by using the frame class of the last frame received before the current frame and a quantity of consecutive lost frames previous to the current frame.

In an embodiment, when a frame class of a last frame received before a current frame is a voiced frame or an unvoiced frame, if a first gain gradient is positive, a value of $\varphi_1$ is relatively small, for example, less than a preset threshold; or if a first gain gradient is negative, a value of $\varphi_1$ is relatively large, for example, greater than a preset threshold.

In an embodiment, when a frame class of a last frame received before a current frame is an onset frame of a voiced frame or an unvoiced frame, if a first gain gradient is positive, a value of $\varphi_1$ is relatively large, for example, greater than a preset threshold; or if a first gain gradient is negative, a value of $\varphi_1$ is relatively small, for example, less than a preset threshold.

In an embodiment, when a frame class of a last frame received before a current frame is a voiced frame or an unvoiced frame, and a quantity of consecutive lost frames is less than or equal to 3, a value of $\varphi_2$ is relatively small, for example, less than a preset threshold.

In an embodiment, when a frame class of a last frame received before a current frame is an onset frame of a voiced frame or an onset frame of an unvoiced frame, and a quantity of consecutive lost frames is less than or equal to 3, a value of $\varphi_2$ is relatively large, for example, greater than a preset threshold.

In an embodiment, for a same type of frames, a smaller quantity of consecutive lost frames indicates a larger value of $\varphi_2$.

In block 120 of FIG. 1, a gain gradient between a subframe previous to the last subframe of the previous frame of the current frame and the last subframe of the previous frame of the current frame is used as the first gain gradient; and the subframe gain of the start subframe of the current frame is estimated according to the subframe gain of the last subframe of the previous frame of the current frame and the first gain gradient, and the frame class of the last frame received before the current frame and the quantity of consecutive lost frames previous to the current frame.

According to this embodiment of the present disclosure, when the previous frame of the current frame is an $(n-1)^{th}$ frame, the current frame is an $n^{th}$ frame, and each frame includes I subframes, the first gain gradient is obtained by using the following formula (4):

$$\text{GainGradFEC}[0]=\text{GainGrad}[n-1,I-2], \tag{4}$$

where GrainGradFEC[0] is the first gain gradient, GrainGrad[n−1,I−2] is a gain gradient between an $(I-2)^{th}$ subframe and an $(I-1)^{th}$ subframe of the previous frame of the current frame, where the subframe gain of the start subframe is obtained by using the following formulas (5), (6), and (7):

$$\text{GainShapeTemp}[n,0]=\text{GainShape}[n-1,I-1]+\lambda_1*\text{GainGradFEC}[0], \tag{5}$$

$$\text{GainShapeTemp}[n,0]=\min(\lambda_2*\text{GainShape}[n-1,I-1],\text{GainShapeTemp}[n,0]), \tag{6}$$

$$\text{GainShape}[n,0]=\max(\lambda_3*\text{GainShape}[n-1,I-1],\text{GainShapeTemp}[n,0]) \tag{7}$$

where GainShape[n−1,I−1] where is a subframe gain of the $(I-1)^{th}$ subframe of the previous frame of the current frame, GainShape[n,0] is the subframe gain of the start subframe, GainShapeTemp[n, 0] is a subframe gain intermediate value of the start subframe, $0<\lambda_1<1.0$, $1<\lambda_2 2<2$, $0<\lambda_3<1.0$, $\lambda_1$ is determined by using a frame class of a last frame received before the current frame and a multiple relationship between subframe gains of last two subframes of the previous frame of the current frame, and $\lambda_2$ and $\lambda_3$ are determined by using the frame class of the last frame received before the current frame and a quantity of consecutive lost frames previous to the current frame.

For example, when a frame class of a last frame received before a current frame is a voiced frame or an unvoiced frame, the current frame may also be a voiced frame or an unvoiced frame. In this case, a larger ratio of a subframe gain of a last subframe in a previous frame to a subframe gain of the second to last subframe indicates a larger value of $\lambda_1$ and a smaller ratio of the subframe gain of the last subframe in the previous frame to the subframe gain of the second to last subframe indicates a smaller value of $\lambda_1$. In addition, a value of $\lambda_1$ when the frame class of the last frame received before the current frame is the unvoiced frame is greater than a value of $\lambda_1$ when the frame class of the last frame received before the current frame is the voiced frame.

For example, if a frame class of a last normal frame is an unvoiced frame, and currently a quantity of consecutive lost frames is 1, the current lost frame follows the last normal frame, there is a very strong correlation between the lost frame and the last normal frame, it may be determined that energy of the lost frame is relatively close to energy of the last normal frame, and values of $\lambda_2$ and $\lambda_3$ may be close to 1. For example, the value of $\lambda_2$ may be 1.2, and the value of $\lambda_3$ may be 0.8.

In 120, weighted averaging is performed on a gain gradient between an $i^{th}$ subframe and an $(i+1)^{th}$ subframe of the previous frame of the current frame and a gain gradient between an $i^{th}$ subframe and an $(i+1)^{th}$ subframe of a previous frame of the previous frame of the current frame, and a gain gradient between an $i^{th}$ subframe and an $(i+1)^{th}$ subframe of the current frame is estimated, where i=0, 1, . . . , I−2, and a weight occupied by the gain gradient between the $i^{th}$ subframe and the $(i+1)^{th}$ subframe of the previous frame of the current frame is greater than a weight occupied by the gain gradient between the $i^{th}$ subframe and the $(i+1)^{th}$ subframe of the previous frame of the previous frame of the current frame; and the subframe gain of the another subframe except for the start subframe in the at least two subframes is estimated according to the gain gradient between the at least two subframes of the current frame and the subframe gain of the start subframe of the current frame, and the frame class of the last frame received before the current frame and the quantity of consecutive lost frames previous to the current frame.

According to this embodiment of the present disclosure, in block 120 of FIG. 1, a weighted averaging may be performed on a gain gradient between an $i^{th}$ subframe and an $(i+1)^{th}$ subframe of the previous frame of the current frame and a gain gradient between an $i^{th}$ subframe and an $(i+1)^{th}$ subframe of a previous frame of the previous frame of the current frame, and a gain gradient between an $i^{th}$ subframe and an $(i+1)^{th}$ subframe of the current frame may be estimated, where i=0, 1, . . . , I−2, and a weight occupied by the gain gradient between the $i^{th}$ subframe and the $(i+1)^{th}$ subframe of the previous frame of the current frame is greater than a weight occupied by the gain gradient between the $i^{th}$ subframe and the $(i+1)^{th}$ subframe of the previous frame of the previous frame of the current frame; and the subframe gain of the another subframe except for the start subframe in the at least two subframes may be estimated according to the gain gradient between the at least two subframes of the current frame and the subframe gain of the start subframe of the current frame, and the frame class of the last frame received before the current frame and the quantity of consecutive lost frames previous to the current frame.

According to this embodiment of the present disclosure, when the previous frame of the current frame is an $(n-1)^{th}$ frame, and the current frame is an $n^{th}$ frame, the gain gradient between the at least two subframes of the current frame is determined by using the following formula (8):

$$GainGradFEC[i+1]=GainGrad[n-2,i]*\beta_1+GainGrad[n-1,i]*\beta_2, \quad (8)$$

where GainGradFEC[i+1] is a gain gradient between an $i^{th}$ subframe and an $(i+1)^{th}$ subframe, GainGrad[n−2,i] is the gain gradient between the $i^{th}$ subframe and the $(i+1)^{th}$ subframe of the previous frame of the previous frame of the current frame, GainGrad[n−1,i] is the gain gradient between the $i^{th}$ subframe and the $(i+1)^{th}$ subframe of the previous frame of the current frame, $\beta_2>\beta_1$, $\beta_2+\beta_1=1.0$, and i=0, 1, 2, . . . , I−2;

where the subframe gain of the another subframe except for the start subframe in the at least two subframes is determined by using the following formulas (9) and (10):

$$GainShapeTemp[n,i]=GainShapeTemp[n,i-1]+GainGradFEC[i]*\beta_3; \quad (9)$$

$$GainShape[n,i]=GainShapeTemp[n,i]*\beta_4; \quad (10)$$

where GainShape[n,i] is a subframe gain of an $i^{th}$ subframe of the current frame, GainShapeTemp[n,i] is a subframe gain intermediate value of the $i^{th}$ subframe of the current frame, $0\leq\beta_3\leq1.0$, $0<\beta_4\leq1.0$, $\beta_3$ is determined by using a multiple relationship between GainGrad[n−1,i] and GainGrad[n−1,i+1] and a plus or minus sign of GainGrad[n−1,i+1], and $\beta_4$ is determined by using the frame class of the last frame received before the current frame and the quantity of consecutive lost frames previous to the current frame.

For example, if GainGrad[n−1,i+1] is a positive value, a larger ratio of GainGrad[n−1,i+1] to GainGrad[n−1,i] indicates a larger value of $\beta_3$; or if GainGradFEC[0] is a negative value, a larger ratio of GainGrad[n−1,i+1] to GainGrad[n−1,i] indicates a smaller value of $\beta_3$.

For example, when a frame class of a last frame received before a current frame is a voiced frame or an unvoiced frame, and a quantity of consecutive lost frames is less than or equal to 3, a value of $\beta_4$ is relatively small, for example, less than a preset threshold.

For example, when a frame class of a last frame received before a current frame is an onset frame of a voiced frame or an onset frame of an unvoiced frame, and a quantity of consecutive lost frames is less than or equal to 3, a value of $\beta_4$ is relatively large, for example, greater than a preset threshold.

For example, for a same type of frames, a smaller quantity of consecutive lost frames indicates a larger value of $\beta_4$.

According to this embodiment of the present disclosure, each frame includes I subframes, and the estimating a gain gradient between the at least two subframes of the current frame according to the gain gradient between the subframes of the at least one frame includes:

performing weighted averaging on I gain gradients between (I+1) subframes previous to an $i^{th}$ subframe of the current frame, and estimating a gain gradient between an $i^{th}$ subframe and an $(i+1)^{th}$ subframe of the current frame, where i=0, 1, . . . , I−2, and a gain gradient between subframes that are closer to the $i^{th}$ subframe occupies a larger weight;

where the estimating the subframe gain of the another subframe except for the start subframe in the at least two subframes according to the gain gradient between the at least two subframes of the current frame and the subframe gain of the start subframe of the current frame includes:

estimating the subframe gain of the another subframe except for the start subframe in the at least two subframes according to the gain gradient between the at least two subframes of the current frame and the subframe gain of the start subframe of the current frame, and the frame class of the last frame received before the current frame and the quantity of consecutive lost frames previous to the current frame.

According to this embodiment of the present disclosure, when the previous frame of the current frame is an $(n-1)^{th}$ frame, the current frame is an $n^{th}$ frame, and each frame includes four subframes, the gain gradient between the at least two subframes of the current frame is determined by using the following formulas (11), (12), and (13):

$$GainGradFEC[1]=GainGrad[n-1,0]*\gamma_1+GainGrad[n-1,1]*\gamma_2+GainGrad[n-1,2]*\gamma_3+GainGradFEC[0]*\gamma_4; \quad (11)$$

$$GainGradFEC[2]=GainGrad[n-1,1]*\gamma_1+GainGrad[n-1,2]*\gamma_2+GainGradFEC[0]*\gamma_3+GainGradFEC[1]*\gamma_4; \quad (12)$$

$$GainGradFEC[3]=GainGrad[n-1,2]*\gamma_1+GainGradFEC[0]*\gamma_2+GainGradFEC[1]*\gamma_3+GainGradFEC[2]*\gamma_4; \quad (13)$$

where GainGradFEC[j] is a gain gradient between a $j^{th}$ subframe and a $(j+1)^{th}$ subframe of the current frame, GainGrad[n−1, j] is a gain gradient between a $j^{th}$ subframe and a $(j+1)^{th}$ subframe of the previous frame of the current frame, j=0, 1, 2, . . . , I−2, $\gamma_1+\gamma_2+\gamma_3+\gamma_4=1.0$, and $\gamma_4>\gamma_3>\gamma_2>\gamma_1$, where $\gamma_1$, $\gamma_2$, $\gamma_3$, and $\gamma_4$ are determined by using the frame class of the received last frame, where the subframe gain of the another subframe except for the start subframe in the at least two subframes is determined by using the following formulas (14), (15), and (16):

$$GainShapeTemp[n,i]=GainShapeTemp[n,i-1]+GainGradFEC[i], \quad (14)$$

where i=1, 2, 3, where GainShapeTemp[n,0] is the first gain gradient;

$$GainShapeTemp[n,i]=\min(\gamma_5*GainShape[n-1,i],GainShapeTemp[n,i]); \quad (15)$$

$$GainShape[n,i]=\max(\gamma_6*GainShape[n-1,i],GainShapeTemp[n,i]) \quad (16);$$

where i=1, 2, 3, GainShapeTemp[n,i] is a subframe gain intermediate value of the $i^{th}$ subframe of the current frame, GainShape[n,i] is a subframe gain of the $i^{th}$ subframe of the current frame, $\gamma_5$ and $\gamma_6$ are determined by using the frame class of the received last frame and the quantity of consecutive lost frames previous to the current frame, $1<\gamma_5<2$, and $0\leq\gamma_6\leq1$.

For example, if a frame class of a last normal frame is an unvoiced frame, and currently a quantity of consecutive lost frames is 1, the current lost frame follows the last normal frame, there is a very strong correlation between the lost frame and the last normal frame, it may be determined that energy of the lost frame is relatively close to energy of the last normal frame, and values of $\gamma_5$ and $\gamma_6$ may be close to 1. For example, the value of $\gamma_5$ may be 1.2, and the value of $\gamma_6$ may be 0.8.

In block 130 of FIG. 1, a global gain gradient of the current frame is estimated according to the frame class of the last frame received before the current frame and the quantity of consecutive lost frames previous to the current frame; and the global gain of the current frame is estimated according to the global gain gradient and a global gain of the previous frame of the current frame.

For example, during estimation of a global gain, a global gain of a lost frame may be estimated on a basis of a global gain of at least one frame (for example, a previous frame) previous to a current frame and by using conditions such as a frame class of a last frame that is received before the current frame and a quantity of consecutive lost frames previous to the current frame.

According to this embodiment of the present disclosure, the global gain of the current frame is determined by using the following formula (17):

$$GainFrame=GainFrame_prevfrm*GainAtten, \quad (17)$$

where GainFrame is the global gain of the current frame, GainFrame_prevfrm is the global gain of the previous frame of the current frame, $0<GainAtten\leq 1.0$, GainAtten is the global gain gradient, and GainAtten is determined by using the frame class of the received last frame and the quantity of consecutive lost frames previous to the current frame.

For example, in a case in which a decoder side determines that a frame class of a current frame is the same as a frame class of a last frame received before the current frame and a quantity of consecutive lost frames is less than or equal to 3, the decoder side may determine that a global gain gradient is 1. In other words, a global gain of a current lost frame may be the same as a global gain of a previous frame, and therefore it may be determined that the global gain gradient is 1.

For example, if it may be determined that a last normal frame is an unvoiced frame or a voiced frame, and a quantity of consecutive lost frames is less than or equal to 3, a decoder side may determine that a global gain gradient is a relatively small value, that is, the global gain gradient may be less than a preset threshold. For example, the threshold may be set to 0.5.

For example, in a case in which a decoder side determines that a last normal frame is an onset frame of a voiced frame, the decoder side may determine a global gain gradient, so that the global gain gradient is greater than a preset first threshold. If determining that the last normal frame is an onset frame of a voiced frame, the decoder side may determine that a current lost frame may be very likely a voiced frame, and then may determine that the global gain gradient is a relatively large value, that is, the global gain gradient may be greater than a preset threshold.

According to this embodiment of the present disclosure, in a case in which the decoder side determines that the last normal frame is an onset frame of an unvoiced frame, the decoder side may determine the global gain gradient, so that the global gain gradient is less than the preset threshold. For example, if the last normal frame is an onset frame of an unvoiced frame, the current lost frame may be very likely an unvoiced frame, and then the decoder side may determine that the global gain gradient is a relatively small value, that is, the global gain gradient may be less than the preset threshold.

In this embodiment of the present disclosure, a gain gradient of subframes and a global gain gradient are estimated by using conditions such as a frame class of a last frame received before frame loss occurs and a quantity of consecutive lost frames, then a subframe gain and a global gain of a current frame are determined with reference to a subframe gain and a global gain of at least one previous frame, and gain control is performed on a reconstructed high frequency band signal by using the two gains, to output a final high frequency band signal. In this embodiment of the present disclosure, when frame loss occurs, fixed values are not used as values of a subframe gain and a global gain that are required during decoding, thereby preventing signal energy discontinuity caused by setting a fixed gain value in a case in which frame loss occurs, so that transition before and after frame loss is more natural and more stable, thereby weakening a noise phenomenon, and improving quality of a reconstructed signal.

Figure 2:
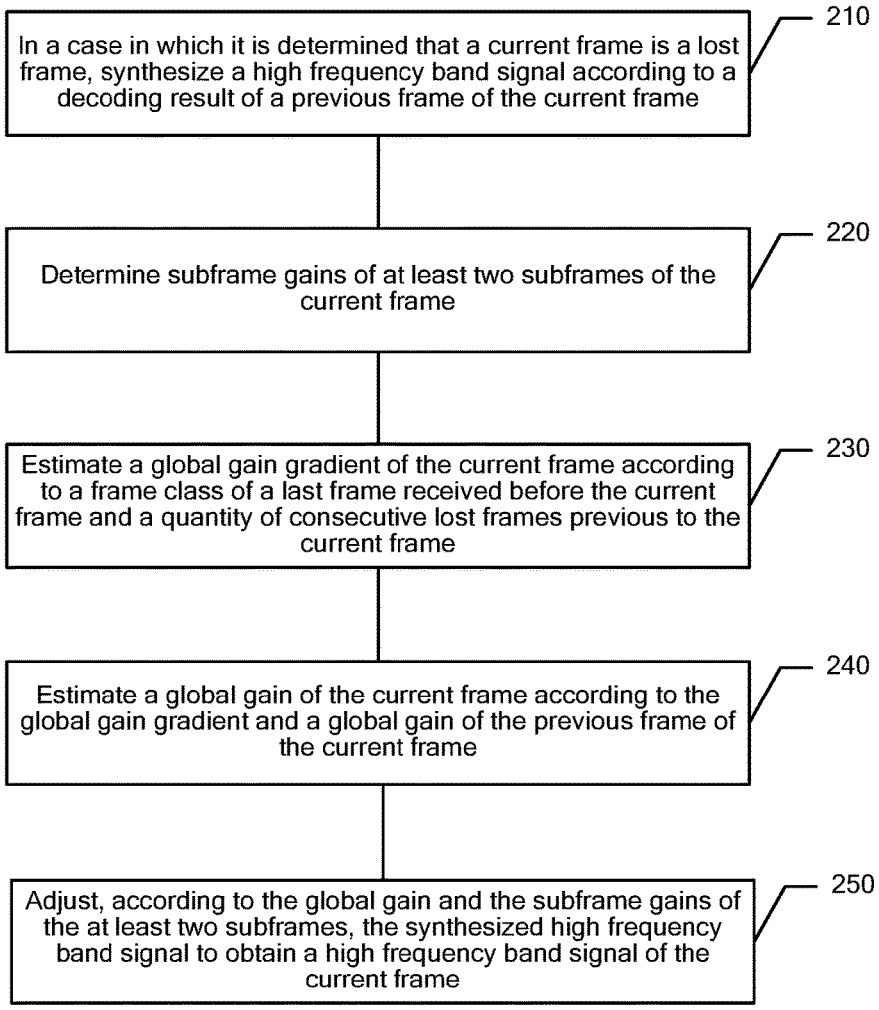
FIG. 2 is a schematic flowchart of a decoding method according to another embodiment of the present disclosure.

FIG. 2 is a schematic flowchart of a decoding method according to another embodiment of the present disclosure. The method in FIG. 2 is executed by a decoder. In block 210 of FIG. 2, in a case in which it is determined that a current frame is a lost frame, synthesize a high frequency band signal according to a decoding result of a previous frame of the current frame. In block 220 of FIG. 2, there is a determination of subframe gains of at least two subframes of the current frame. In block 230 of FIG. 2 there is an estimation a global gain gradient of the current frame according to a frame class of a last frame received before the current frame and a quantity of consecutive lost frames previous to the current frame. In block 240 of FIG. 2, there is an estimation of a global gain of the current frame according to the global gain gradient and a global gain of the previous frame of the current frame. In block 250 of FIG. 2 there is an adjustment, according to the global gain and the subframe gains of the at least two subframes, the synthesized high frequency band signal to obtain a high frequency band signal of the current frame.

According to this embodiment of the present disclosure, the global gain of the current frame is determined by using the following formula:

GainFrame=GainFrame_prevfrm*GainAtten, where GainFrame is the global gain of the current frame, GainFrame_prevfrm is the global gain of the previous frame of the current frame, $0<GainAtten\leq 1.0$, GainAtten is the global gain gradient, and GainAtten is determined by using the frame class of the received last frame and the quantity of consecutive lost frames previous to the current frame.

Figure 3A:
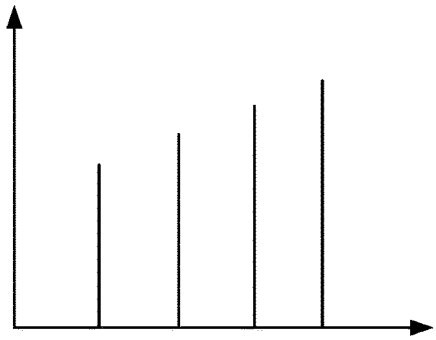
FIG. 3A is a diagram of a change trend of subframe gains of a previous frame of a current frame according to an embodiment of the present disclosure.
Figure 3B:
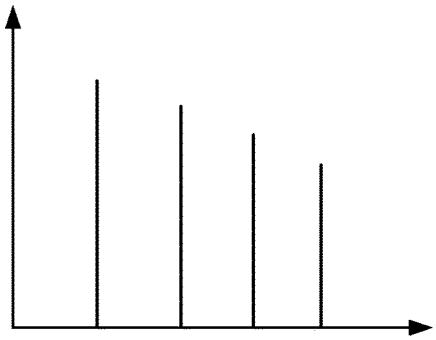
FIG. 3B is a diagram of a change trend of subframe gains of a previous frame of a current frame according to another embodiment of the present disclosure.
Figure 3C:
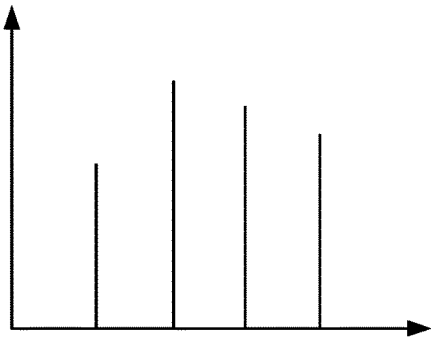
FIG. 3C is a diagram of a change trend of subframe gains of a previous frame of a current frame according to still another embodiment of the present disclosure.

FIG. 3A to FIG. 3C are diagrams of change trends of subframe gains of a previous frame according to embodiments of the present disclosure. FIG. 3A illustrates a rising gain, FIG. 3B illustrates a falling gain, and FIG. 3C illustrates a rising then falling gain.

Figure 4:
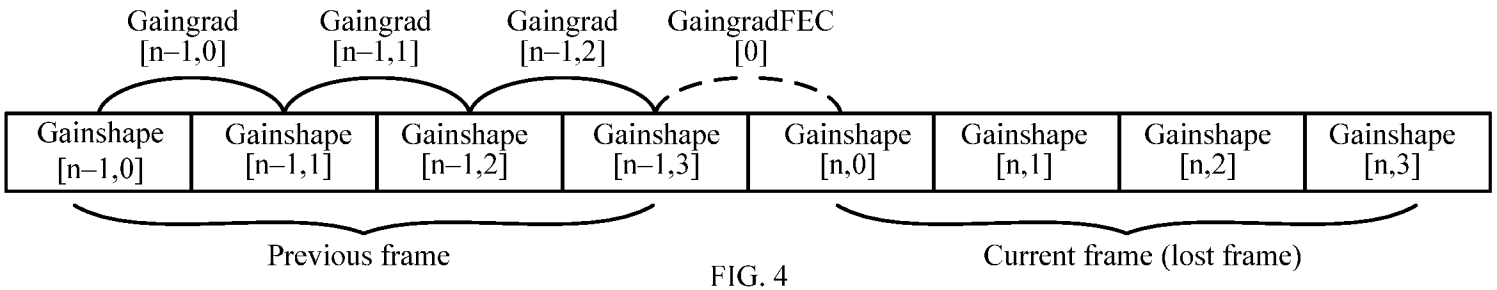
FIG. 4 is a schematic diagram of a process of estimating a first gain gradient according to an embodiment of the present disclosure.
Figure 5:
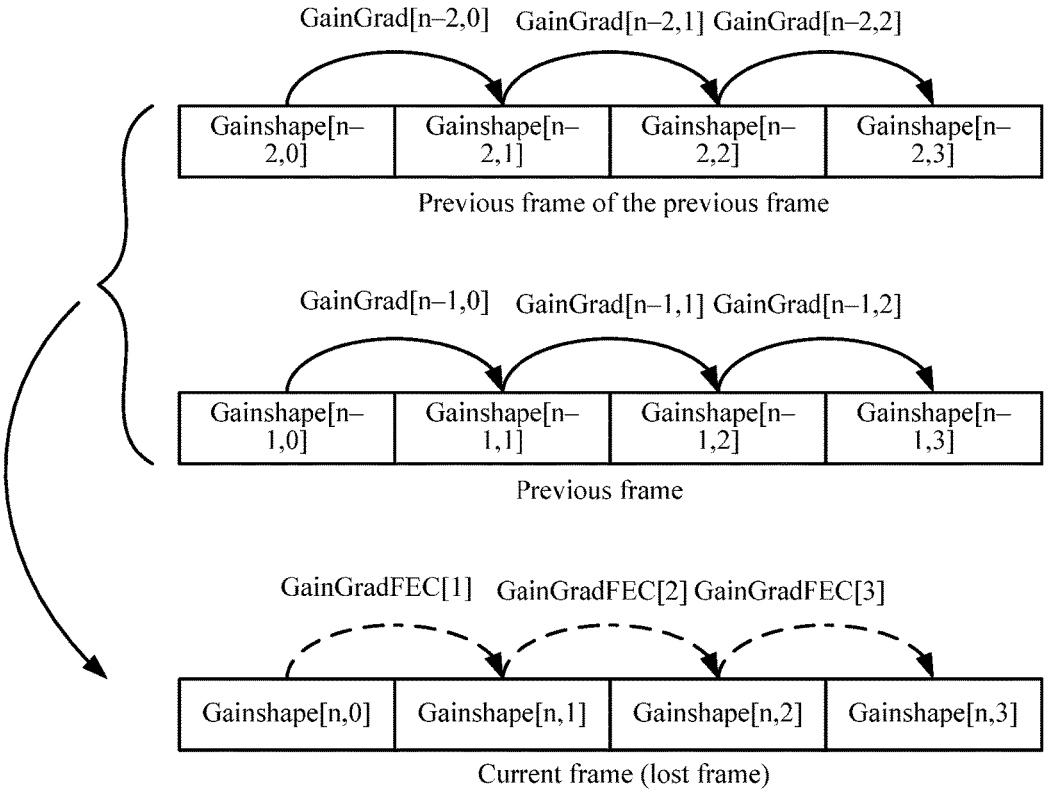
FIG. 5 is a schematic diagram of a process of estimating a gain gradient between at least two subframes of a current frame according to an embodiment of the present disclosure.
Figure 6:
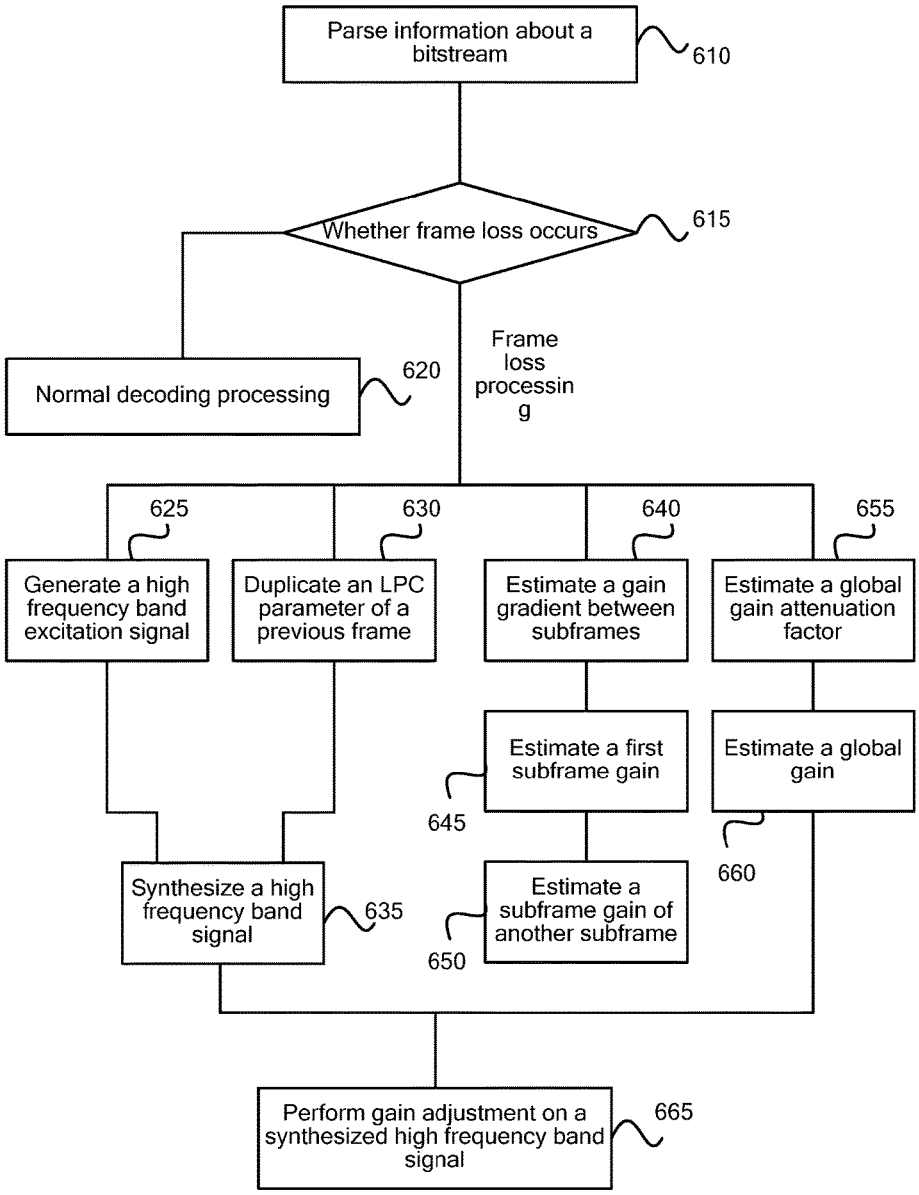
FIG. 6 is a schematic flowchart of a decoding process according to an embodiment of the present disclosure.

FIG. 4 is a schematic diagram of a process of estimating a first gain gradient according to an embodiment of the present disclosure. FIG. 4 illustrates both the previous frame and a current frame. FIG. 4 further illustrates the gaingrad within the previous frame. FIG. 5 is a schematic diagram of a process of estimating a gain gradient between at least two subframes of a current frame according to an embodiment of the present disclosure. FIG. 6 is a schematic flowchart of a decoding process according to an embodiment of the present disclosure. This embodiment in FIG. 6 is an example of the method in FIG. 1.

In block 610 of FIG. 6, a decoder side parses information about a bitstream received by a coder side. In block 615 of FIG. 6, there is a determination, according to a frame loss flag parsed out from the information about the bitstream, whether frame loss occurs. In block 620 of FIG. 6, if frame loss does not occur, perform normal decoding processing according to a bitstream parameter obtained from the bitstream.

During decoding, firstly, dequantization is performed on an LSF parameter, a subframe gain, and a global gain, and the LSF parameter is converted into an LPC parameter, thereby obtaining an LPC synthesis filter; secondly, parameters such as a pitch period, an algebraic codebook, and a respective gain are obtained by using a core decoder, a high frequency band excitation signal is obtained based on the parameters such as the pitch period, the algebraic codebook, and the respective gain, and a high frequency band signal is synthesized from the high frequency band excitation signal by using the LPC synthesis filter, and finally gain adjustment is performed on the high frequency band signal according to the subframe gain and the global gain, to recover the final high frequency band signal.

If frame loss occurs, frame loss processing is performed. Frame loss processing includes blocks 625 to 660 of FIG. 6.

In block 625 of FIG. 6, parameters such as a pitch period, an algebraic codebook, and a respective gain of a previous frame by using a core decoder are obtained, and on a basis of the parameters such as the pitch period, the algebraic codebook, and the respective gain, obtain a high frequency band excitation signal.

In block 630 of FIG. 6 an LPC parameter of the previous frame is duplicated.

In block 635 of FIG. 6, the flowchart illustrates obtaining an LPC synthesis filter according to LPC of the previous frame, and synthesize a high frequency band signal from the high frequency band excitation signal by using the LPC synthesis filter.

In block 640 of FIG. 6 the flowchart illustrates estimating a first gain gradient from a last subframe of the previous frame to a start subframe of the current frame according to a gain gradient between subframes of the previous frame.

In this embodiment, description is provided by using an example in which each frame has in total gains of four subframes. It is assumed that the current frame is an $n^{th}$ frame, that is, the $n^{th}$ frame is a lost frame. A previous frame is an $(n-1)^{th}$ frame, and a previous frame of the previous frame is an $(n-2)^{th}$ frame. Gains of four subframes of the $n^{th}$ frame are GainShape[n,0], GainShape[n,1], GainShape[n,2], and GainShape[n,3]. Similarly, gains of four subframes of the $(n-1)^{th}$ frame are GainShape[n−1,0], GainShape[n−1,1], GainShape[n−1,2], and GainShape[n−1,3], and gains of four subframes of the $(n-2)^{th}$ frame are GainShape[n−2,0], GainShape[n−2,1], GainShape[n−2,2], and GainShape[n−2,3]. In this embodiment of the present disclosure, different estimation algorithms are used for a subframe gain GainShape[n,0] (that is, a subframe gain of the current frame whose serial number is 0) of a first subframe of the $n^{th}$ frame and subframe gains of the next three subframes. A procedure of estimating the subframe gain GainShape[n,0] of the first subframe is: a gain variation is calculated according to a change trend and degree between subframe gains of the $(n-1)^{th}$ frame, and the subframe gain GainShape[n,0] of the first subframe is estimated by using the gain variation and the gain GainShape[n−1,3] of the fourth subframe (that is, a gain of a subframe of the previous frame whose serial number is 3) of the $(n-1)^{th}$ frame and with reference to a frame class of a last frame received before the current frame and a quantity of consecutive lost frames. An estimation procedure for the next three subframes is: a gain variation is calculated according to a change trend and degree between a subframe gain of the $(n-1)^{th}$ frame and a subframe gain of the $(n-2)^{th}$ frame, and the gains of the next three subframes are estimated by using the gain variation and the estimated subframe gain of the first subframe of the $n^{th}$ subframe and with reference to the frame class of the last frame received before the current frame and the quantity of consecutive lost frames.

As shown in FIG. 3A, the change trend and degree (or gradient) between gains of the $(n-1)^{th}$ frame is monotonically increasing. As shown in FIG. 3B, the change trend and degree (or gradient) between gains of the $(n-1)^{th}$ frame is monotonically decreasing. A formula for calculating the first gain gradient may be as follows:

$$\text{GainGradFEC}[0]=\text{GainGrad}[n-1,1]*\alpha_1+\text{GainGrad}[n-1,2]*\alpha_2,$$

where GainGradFEC[0] is the first gain gradient, that is, a gain gradient between a last subframe of the $(n-1)^{th}$ frame and the first subframe of the $n^{th}$ frame, GainGrad[n−1,1] is a gain gradient between a first subframe and a second subframe of the $(n-1)^{th}$ subframe, $\alpha_2>\alpha_1$, and $\alpha_1+\alpha_2=1$, that is, a gain gradient between subframes that are closer to the $n^{th}$ subframe occupies a larger weight. For example, $\alpha_1=0.1$, and $\alpha_2=0.9$.

As shown in FIG. 3C, the change trend and degree (or gradient) between gains of the $(n-1)^{th}$ frame is not monotonic (for example, is random). A formula for calculating the gain gradient may be as follows:

$$\text{GainGradFEC}[0]=\text{GainGrad}[n-1,0]*\alpha_1+\text{GainGrad}[n-1,1]*\alpha_2+\text{GainGrad}[n-1,2]*\alpha_3,$$

where $\alpha_3>\alpha_2>\alpha_1$, and $\alpha_1+\alpha_2+\alpha_3=1.0$, that is, a gain gradient between subframes that are closer to the $n^{th}$ subframe occupies a larger weight. For example, $\alpha_1=0.2$, $\alpha_2=0.3$, and $\alpha_3=0.5$.

In block 645 of FIG. 6 the flowchart illustrates estimating a subframe gain of the start subframe of the current frame according to a subframe gain of the last subframe of the previous frame and the first gain gradient.

In this embodiment of the present disclosure, an intermediate amount GainShapeTemp[n,0] of the subframe gain GainShape[n,0] of the first subframe of the $n^{th}$ frame may be calculated according to a frame class of a last frame received before the $n^{th}$ frame and the first gain gradient GainGradFEC[0]. Specific steps are as follows:

$$\text{GainShapeTemp}[n,0]=\text{GainShape}[n-1,3]+\varphi_1*\text{GainGradFEC}[0],$$

where $0\leq\varphi_1\leq1.0$, and $\varphi_1$ is determined by using the frame class of the last frame received before the $n^{th}$ frame and positivity or negativity of GainGradFEC[0].

GainShape[n,0] is obtained through calculation according to the intermediate amount GainShapeTemp[n,0]:

$$\text{GainShape}[n,0]=\text{GainShapeTemp}[n,0]*\varphi_2,$$

where $\varphi_2$ is determined by using the frame class of the last frame received before the $n^{th}$ frame and a quantity of consecutive lost frames previous to the $n^{th}$ frame.

In block 650 of FIG. 6 the flowchart illustrates estimating a gain gradient between multiple subframes of the current frame according to a gain gradient between subframes of at least one frame; and estimate a subframe gain of another subframe except for the start subframe in the multiple subframes according to the gain gradient between the multiple subframes of the current frame and the subframe gain of the start subframe of the current frame.

Referring to FIG. 5, in this embodiment of the present disclosure, a gain gradient GainGradFEC[i+1] between the at least two subframes of the current frame may be estimated according to a gain gradient between subframes of the $(n-1)^{th}$ frame and a gain gradient between subframes of the $(n-2)^{th}$ frame:

$$GainGradFEC[i+1]=GainGrad[n-2,i]*\beta_1 belta1+GainGrad[n-1,i]*\beta_2,$$

where i=0, 1, 2, and $\beta_1+\beta_2=1.0$, that is, a gain gradient between subframes that are closer to the $n^{th}$ subframe occupies a larger weight, for example, $\beta_1=0.4$, and $\beta_2=0.6$.

An intermediate amount GainShapeTemp[n,i] of subframe gains of subframes is calculated according to the following formula:

$$GainShapeTemp[n,i]=GainShapeTemp[n,i-1]+GainGradFEC[i]*\beta_3,$$

where i=1, 2, 3, $0<\beta_3\leq 1.0$, and $\beta_3$ may be determined by using GainGrad[n−1,x]; for example, when GainGrad[n−1,2] is greater than 10.0*GainGrad[n−1,1], and GainGrad[n−1,1] is greater than 0, a value of $\beta_3$ is 0.8.

The subframe gains of the subframes are calculated according to the following formula:

$$GainShape[n,i]=GainShapeTemp[n,i]*\beta_4,$$

where i=1, 2, 3, and $\beta_4$ is determined by using the frame class of the last frame received before the $n^{th}$ frame and the quantity of consecutive lost frames previous to the $n^{th}$ frame.

In block 655 of FIG. 6 the flowchart illustrates estimating a global gain gradient according to a frame class of a last frame received before the current frame and a quantity of consecutive lost frames previous to the current frame.

A global gain gradient GainAtten may be determined according to the frame class of the last frame received before the current frame and the quantity of consecutive lost frames, and 0<GainAtten<1.0. For example, a basic principle of determining a global gain gradient may be: when a frame class of a last frame received before a current frame is a friction sound, the global gain gradient takes a value close to 1, for example, GainAtten=0.95. For example, when the quantity of consecutive lost frames is greater than 1, the global gain gradient takes a relatively small value (for example, which is close to 0), for example, GainAtten=0.5.

In block 660 of FIG. 6 the flowchart illustrates estimating a global gain of the current frame according to the global gain gradient and a global gain of the previous frame of the current frame. A global gain of a current lost frame may be obtained by using the following formula:

$$GainFrame=GainFrame_prevfrm*GainAtten,$$

where GainFrame_prevfrm is the global gain of the previous frame.

In block 665 of FIG. 6 the flowchart illustrates performing gain adjustment on a synthesized high frequency band signal according to the global gain and the subframe gains, thereby recovering a high frequency band signal of the current frame. This step is similar to a conventional technique, and details are not described herein again.

In this embodiment of the present disclosure, a conventional frame loss processing method in a time domain high bandwidth extension technology is used, so that transition when frame loss occurs is more natural and more stable, thereby weakening a noise (click) phenomenon caused by frame loss, and improving quality of a speech signal.

Optionally, as another embodiment, block 640 and block 645 in this embodiment in FIG. 6 may be replaced with the following steps:

First step: Use a change gradient GainGrad[n−1,2], from a subframe gain of the second to last subframe to a subframe gain of a last subframe in an $(n-1)^{th}$ frame (which is the previous frame), as a first gain gradient GainGradFEC[0], that is, GainGradFEC[0]=GainGrad[n−1,2].

Second step: On a basis of the subframe gain of the last subframe of the $(n-1)^{th}$ frame and with reference to a frame class of a last frame received before the current frame and the first gain gradient GainGradFEC[0], calculate an intermediate amount GainShapeTemp[n,0] of a gain GainShape[n,0] of a first subframe:

$$GainShapeTemp[n,0]=GainShape[n-1,3]+\lambda_1*GainGradFEC[0],$$

where GainShape[n−1,3] is a gain of a fourth subframe of the $(n-1)^{th}$ frame, $0<\lambda_1<1.0$, and $\lambda_1$ is determined by using a multiple relationship between a frame class of a last frame received before the $n^{th}$ frame and gains of last two subframes of the previous frame.

Third step: Obtain GainShape[n,0] through calculation according to the intermediate amount GainShapeTemp[n,0]:

$$GainShapeTemp[n,0]=\min(\lambda_2*GainShape[n-1,3], GainShapeTemp[n,0]);$$

and $$GainShape[n,0]=\max(\lambda_3*GainShape[n-1,3], GainShapeTemp[n,0]);$$

where $\lambda_2$ and $\lambda_3$ are determined by using the frame class of the last frame received before the current frame and the quantity of consecutive lost frames, and a ratio of the estimated subframe gain GainShape[n,0] of a first subframe to the subframe gain GainShape[n−1,3] of the last subframe of the $(n-1)^{th}$ frame is within a range.

Optionally, as another embodiment, block 650 in this embodiment of FIG. 6 may be replaced with the following steps:

First step: Estimate gain gradients GainGradFEC[1] to GainGradFEC[3] between subframes of an $n^{th}$ frame according to GainGrad[n−1,x] and GainGradFEC[0]:

$$GainGradFEC[1]=GainGrad[n-1,0]*\gamma_1+GainGrad[n-1,1]*\gamma_2+GainGrad[n-1,2]*\gamma_3+GainGradFEC[0]*\gamma_4;$$

$$GainGradFEC[2]=GainGrad[n-1,1]*\gamma_1+GainGrad[n-1,2]*\gamma_2+GainGradFEC[0]*\gamma_3+GainGradFEC[1]*\gamma_4;$$

and $$GainGradFEC[3]=GainGrad[n-1,2]*\gamma_1+GainGradFEC[0]*\gamma_2+GainGradFEC[1]*\gamma_3+GainGradFEC[2]*\gamma_4;$$

where $\gamma_1+\gamma_2+\gamma_3+\gamma_4=1.0$, $\gamma_4>\gamma_3>\gamma_2>\gamma_1$, and $\gamma_1$, $\gamma_2$, $\gamma_3$, and $\gamma_4$ are determined by using a frame class of a last frame received before the current frame.

Second step: Calculate intermediate amounts GainShapeTemp[n,1] to GainShapeTemp[n,3] of subframe gains GainShape[n,1] to GainShape[n,3] between the subframes of the $n^{th}$ frame:

$$GainShapeTemp[n,i]=GainShapeTemp[n,i-1]+GainGradFEC[i],$$

where i=1, 2, 3, and GainShapeTemp[n,0] is a subframe gain of a first subframe of the $n^{th}$ frame.

Third step: Calculate subframe gains GainShape[n,1] to GainShape[n,3] between the subframes of the $n^{th}$ frame according to the intermediate amounts GainShapeTemp[n,1] to GainShapeTemp[n,3]:

GainShapeTemp[$n,i$]=min($\gamma_5$*GainShape[$n-1,i$],GainShapeTemp[$n,i$]);

and

GainShape[$n,i$]=max($\gamma_6$*GainShape[$n-1,i$],GainShapeTemp[$n,i$]);

where i=1, 2, 3, and $\gamma_5$ and $\gamma_6$ are determined by using the frame class of the last frame received before the $n^{th}$ frame and the quantity of consecutive lost frames previous to the $n^{th}$ frame.

Figure 7:
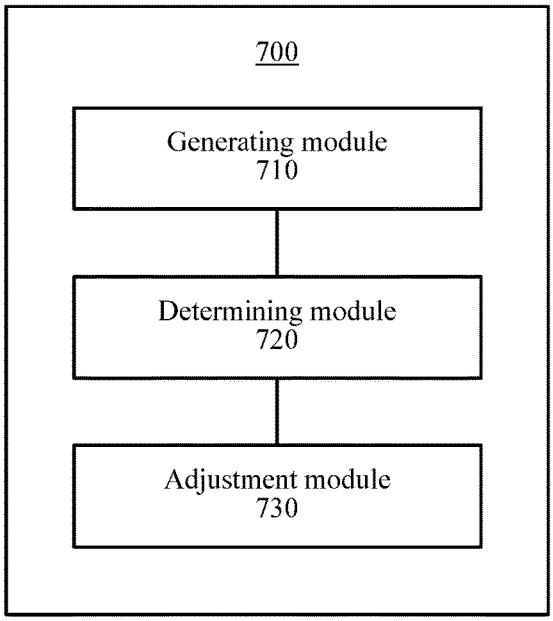
FIG. 7 is a schematic structural diagram of a decoding apparatus according to an embodiment of the present disclosure.

FIG. 7 is a schematic structural diagram of a decoding apparatus 700 according to an embodiment of the present disclosure. The decoding apparatus 700 includes a generating module 710, a determining module 720, and an adjusting module 730.

The generating module 710 is conFigured to: in a case in which it is determined that a current frame is a lost frame, synthesize a high frequency band signal according to a decoding result of a previous frame of the current frame. The determining module 720 is conFigured to determine subframe gains of at least two subframes of the current frame according to subframe gains of subframes of at least one frame previous to the current frame and a gain gradient between the subframes of the at least one frame, and determine a global gain of the current frame. The adjusting module 730 is conFigured to adjust, according to the global gain and the subframe gains of the at least two subframes that are determined by the determining module, the high frequency band signal synthesized by the generating module, to obtain a high frequency band signal of the current frame.

According to this embodiment of the present disclosure, the determining module 720 determines a subframe gain of a start subframe of the current frame according to the subframe gains of the subframes of the at least one frame and the gain gradient between the subframes of the at least one frame; and determines a subframe gain of another subframe except for the start subframe in the at least two subframes according to the subframe gain of the start subframe of the current frame and the gain gradient between the subframes of the at least one frame.

According to this embodiment of the present disclosure, the determining module 720 estimates a first gain gradient between a last subframe of the previous frame of the current frame and the start subframe of the current frame according to a gain gradient between subframes of the previous frame of the current frame; estimates the subframe gain of the start subframe of the current frame according to a subframe gain of the last subframe of the previous frame of the current frame and the first gain gradient; estimates a gain gradient between the at least two subframes of the current frame according to the gain gradient between the subframes of the at least one frame; and estimates the subframe gain of the another subframe except for the start subframe in the at least two subframes according to the gain gradient between the at least two subframes of the current frame and the subframe gain of the start subframe of the current frame.

According to this embodiment of the present disclosure, the determining module 720 performs weighted averaging on a gain gradient between at least two subframes of the previous frame of the current frame, to obtain the first gain gradient, and estimates the subframe gain of the start subframe of the current frame according to the subframe gain of the last subframe of the previous frame of the current frame and the first gain gradient, and the frame class of the last frame received before the current frame and the quantity of consecutive lost frames previous to the current frame, where when the weighted averaging is performed, a gain gradient between subframes of the previous frame of the current frame that are closer to the current frame occupies a larger weight.

According to this embodiment of the present disclosure, when the previous frame of the current frame is an $(n-1)^{th}$ frame, the current frame is an $n^{th}$ frame, and each frame includes I subframes, the first gain gradient is obtained by using the following formula:

$$GainGradFEC[0] = \sum_{j=0}^{I-2} GainGrad[n-1, j] * \alpha_j,$$

where GainGradFEC[0] is the first gain gradient, GainGrad [n−1, j] is a gain gradient between a $j^{th}$ subframe and a $(j+1)^{th}$ subframe of the previous frame of the current frame, $$\alpha_{j+1} \geq \alpha_j,$$

$$\sum_{j=0}^{I-2} \alpha_j = 1,$$

and j=0, 1, 2, . . . , I−2, where the subframe gain of the start subframe is obtained by using the following formulas:

GainShapeTemp[$n$,0]=GainShape[$n-1,I-1$]+$\varphi_1$*GainGradFEC[0];

and

GainShape[$n$,0]=GainShapeTemp[$n$,0]*$\varphi_2$;

where GainShape[n−1, I−1] is a subframe gain of an $(I-1)^{th}$ subframe of the $(n-1)^{th}$ frame, GainShape[n,0] is the subframe gain of the start subframe of the current frame, GainShapeTemp[n,0] is a subframe gain intermediate value of the start subframe, $0 \leq \varphi_1 \leq 1.0$, $0 < \varphi_2 \leq 1.0$, $\varphi_1$ is determined by using a frame class of a last frame received before the current frame and a plus or minus sign of the first gain gradient, and $\varphi_2$ is determined by using the frame class of the last frame received before the current frame and a quantity of consecutive lost frames previous to the current frame.

According to this embodiment of the present disclosure, the determining module 720 uses a gain gradient, between a subframe previous to the last subframe of the previous frame of the current frame and the last subframe of the previous frame of the current frame, as the first gain gradient; and estimates the subframe gain of the start subframe of the current frame according to the subframe gain of the last subframe of the previous frame of the current frame and the first gain gradient, and the frame class of the last frame received before the current frame and the quantity of consecutive lost frames previous to the current frame.

According to this embodiment of the present disclosure, when the previous frame of the current frame is an $(n-1)^{th}$ frame, the current frame is an $n^{th}$ frame, and each frame includes I subframes, the first gain gradient is obtained by using the following formula: GainGradFEC[0]=GainGrad [n−1, I−2], where GainGradFEC[0] is the first gain gradient, GainGrad[n−1, I−2] is a gain gradient between an $(I-2)^{th}$ subframe and an $(I-1)^{th}$ subframe of the previous frame of the current frame, where the subframe gain of the start subframe is obtained by using the following formulas:

$$GainShapeTemp[n,0]=GainShape[n-1,I-1]+\lambda_1*GainGradFEC[0];$$

$$GainShapeTemp[n,0]=\min(\lambda_2*GainShape[n-1,I-1], GainShapeTemp[n,0]);$$

and $$GainShape[n,0]=\max(\lambda_3*GainShape[n-1,I-1], GainShapeTemp[n,0]);$$

where GainShape[n−1,I−1] is a subframe gain of the $(I-1)^{th}$ subframe of the previous frame of the current frame, GainShape[n,0] is the subframe gain of the start subframe, GainShapeTemp[n,0] is a subframe gain intermediate value of the start subframe, $0<\lambda_1<1.0$, $1<\lambda_2<2$, $0<\lambda_3<1.0$, $\lambda_1$ is determined by using a frame class of a last frame received before the current frame and a multiple relationship between subframe gains of last two subframes of the previous frame of the current frame, and $\lambda_2$ and $\lambda_3$ are determined by using the frame class of the last frame received before the current frame and a quantity of consecutive lost frames previous to the current frame.

According to this embodiment of the present disclosure, each frame includes I subframes, the determining module 720 performs weighted averaging on a gain gradient between an $i^{th}$ subframe and an $(i+1)^{th}$ subframe of the previous frame of the current frame and a gain gradient between an $i^{th}$ subframe and an $(i+1)^{th}$ subframe of a previous frame of the previous frame of the current frame, and estimates a gain gradient between an $i^{th}$ subframe and an $(i+1)^{th}$ subframe of the current frame, where i=0, 1, . . . , I−2, and a weight occupied by the gain gradient between the $i^{th}$ subframe and the $(i+1)^{th}$ subframe of the previous frame of the current frame is greater than a weight occupied by the gain gradient between the $i^{th}$ subframe and the $(i+1)^{th}$ subframe of the previous frame of the previous frame of the current frame; and the determining module 720 estimates the subframe gain of the another subframe except for the start subframe in the at least two subframes according to the gain gradient between the at least two subframes of the current frame and the subframe gain of the start subframe of the current frame, and the frame class of the last frame received before the current frame and the quantity of consecutive lost frames previous to the current frame.

According to this embodiment of the present disclosure, the gain gradient between the at least two subframes of the current frame is determined by using the following formula:

$$GainGradFEC[i+1]=GainGrad[n-2,i]*\beta_1+GainGrad[n-1,i]*\beta_2,$$

where GainGradFEC[i+1] is a gain gradient between an $i^{th}$ subframe and an $(i+1)^{th}$ subframe, GainGrad[n−2,i] is the gain gradient between the $i^{th}$ subframe and the $(i+1)^{th}$ subframe of the previous frame of the previous frame of the current frame, GainGrad[n−1,i] is the gain gradient between the $i^{th}$ subframe and the $(i+1)^{th}$ subframe of the previous frame of the current frame, $\beta_2>\beta_1$, $\beta_2+\beta_1=1.0$, and i=0, 1, 2, . . . , I−2, where the subframe gain of the another subframe except for the start subframe in the at least two subframes is determined by using the following formulas:

$$GainShapeTemp[n,i]=GainShapeTemp[n,i-1]+GainGradFEC[i]*\beta_3;$$

and $$GainShape[n,i]=GainShapeTemp[n,i]*\beta_4;$$

where GainShape[n,i] is a subframe gain of an $i^{th}$ subframe of the current frame, GainShapeTemp[n,i] is a subframe gain intermediate value of the $i^{th}$ subframe of the current frame, $0\le\beta_3\le1.0$, $0<\beta_4\le1.0$, $\beta_3$ is determined by using a multiple relationship between GainGrad[n−1,i] and GainGrad[n−1,i+1] and a plus or minus sign of GainGrad [n−1,i+1], and $\beta_4$ is determined by using the frame class of the last frame received before the current frame and the quantity of consecutive lost frames previous to the current frame.

According to this embodiment of the present disclosure, the determining module 720 performs weighted averaging on I gain gradients between (I+1) subframes previous to an $i^{th}$ subframe of the current frame, and estimates a gain gradient between an $i^{th}$ subframe and an $(i+)^{th}$ subframe of the current frame, where i=0, 1, . . . , I−2, and a gain gradient between subframes that are closer to the $i^{th}$ subframe occupies a larger weight, and estimates the subframe gain of the another subframe except for the start subframe in the at least two subframes according to the gain gradient between the at least two subframes of the current frame and the subframe gain of the start subframe of the current frame, and the frame class of the last frame received before the current frame and the quantity of consecutive lost frames previous to the current frame.

According to this embodiment of the present disclosure, when the previous frame of the current frame is an $(n-1)^{th}$ frame, the current frame is an $n^{th}$ frame, and each frame includes four subframes, the gain gradient between the at least two subframes of the current frame is determined by using the following formulas:

$$GainGradFEC[1]=GainGrad[n-1,0]*\gamma_1+GainGrad[n-1,1]*\gamma_2+GainGrad[n-1,2]*\gamma_3+GainGradFEC[0]*\gamma_4;$$

$$GainGradFEC[2]=GainGrad[n-1,1]*\gamma_1+GainGrad[n-1,2]*\gamma_2+GainGradFEC[0]*\gamma_3+GainGradFEC[1]*\gamma_4;$$

and $$GainGradFEC[3]=GainGrad[n-1,2]*\gamma_1+GainGradFEC[0]*\gamma_2+GainGradFEC[1]*\gamma_3+GainGradFEC[2]*\gamma_4;$$

where GainGradFEC[j] is a gain gradient between a $j^{th}$ subframe and a $(j+1)^{th}$ subframe of the current frame, GainGrad[n−1,j] is a gain gradient between a $j^{th}$ subframe and a $(j+1)^{th}$ subframe of the previous frame of the current frame, j=0, 1, 2, . . . , I−2, $\gamma_1+\gamma_2+\gamma_3+\gamma_4=1.0$, and $\gamma_4>\gamma_3>\gamma_2>\gamma_1$, where $\gamma_1$, $\gamma_2$, $\gamma_3$, and $\gamma_4$ are determined by using the frame class of the received last frame, where the subframe gain of the another subframe except for the start subframe in the at least two subframes is determined by using the following formulas:

$$GainShapeTemp[n,i]=GainShapeTemp[n,i-1]+GainGradFEC[i],$$

where i=1, 2, 3, and GainShapeTemp[n,0] is the first gain gradient;

$$GainShapeTemp[n,i]=\min(\gamma_5*GainShape[n-1,i], GainShapeTemp[n,i]);$$

and $$GainShape[n,i]=\max(\gamma_6*GainShape[n-1,i], GainShapeTemp[n,i]);$$

where GainShapeTemp[n,i] is a subframe gain intermediate value of the $i^{th}$ subframe of the current frame, i=1, 2, 3, GainShape[n,i] is a subframe gain of the $i^{th}$ subframe of the current frame, $\gamma_5$ and $\gamma_6$ are determined by using the frame class of the received last frame and the quantity of consecutive lost frames previous to the current frame, $1<\gamma_5<2$, and $0\leq\gamma_6\leq1$.

According to this embodiment of the present disclosure, the determining module 720 estimates a global gain gradient of the current frame according to the frame class of the last frame received before the current frame and the quantity of consecutive lost frames previous to the current frame; and estimates the global gain of the current frame according to the global gain gradient and a global gain of the previous frame of the current frame.

According to this embodiment of the present disclosure, the global gain of the current frame is determined by using the following formula:

$$GainFrame=GainFrame_prevfrm*GainAtten,$$

where GainFrame is the global gain of the current frame, GainFrame_prevfrm is the global gain of the previous frame of the current frame, $0<GainAtten\leq1.0$, GainAtten is the global gain gradient, and GainAtten is determined by using the frame class of the received last frame and the quantity of consecutive lost frames previous to the current frame.

Figure 8:
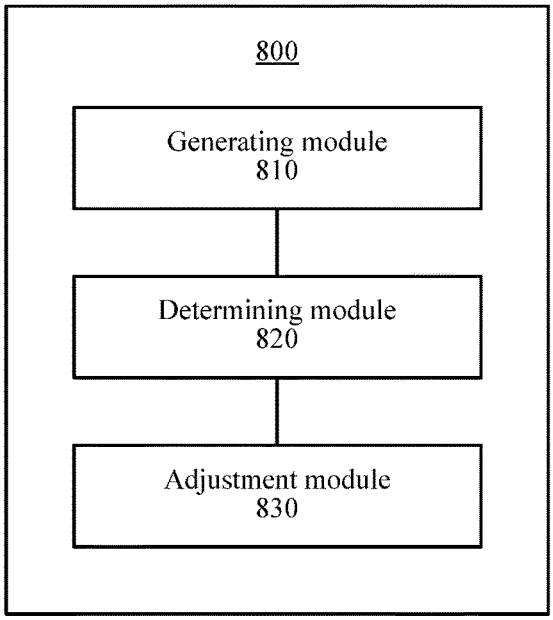
FIG. 8 is a schematic structural diagram of a decoding apparatus according to another embodiment of the present disclosure.

FIG. 8 is a schematic structural diagram of a decoding apparatus 800 according to another embodiment of the present disclosure. The decoding apparatus 800 includes a generating module 810, a determining module 820, and an adjusting module 830.

In a case in which it is determined that a current frame is a lost frame, the generating module 810 synthesizes a high frequency band signal according to a decoding result of a previous frame of the current frame. The determining module 820 determines subframe gains of at least two subframes of the current frame, estimates a global gain gradient of the current frame according to a frame class of a last frame received before the current frame and a quantity of consecutive lost frames previous to the current frame, and estimates a global gain of the current frame according to the global gain gradient and a global gain of the previous frame of the current frame. The adjusting module 830 adjusts, according to the global gain and the subframe gains of the at least two subframes that are determined by the determining module, the high frequency band signal synthesized by the generating module, to obtain a high frequency band signal of the current frame.

According to this embodiment of the present disclosure, GainFrame=GainFrame_prevfrm*GainAtten, where GainFrame is the global gain of the current frame, GainFrame_prevfrm is the global gain of the previous frame of the current frame, $0<GainAtten\leq1.0$, GainAtten is the global gain gradient, and GainAtten is determined by using the frame class of the received last frame and the quantity of consecutive lost frames previous to the current frame.

Figure 9:
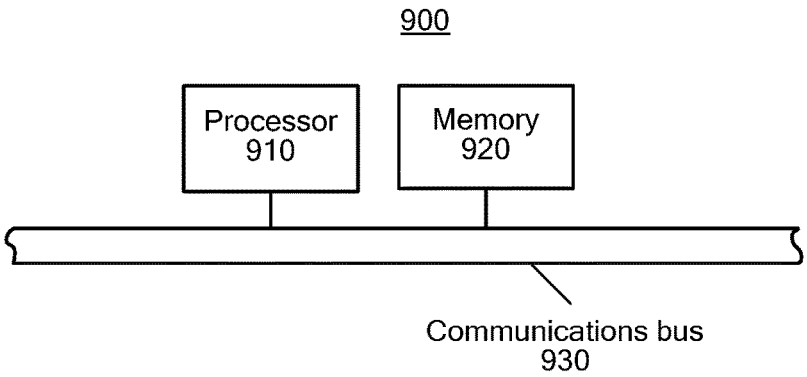
FIG. 9 is a schematic structural diagram of a decoding apparatus according to another embodiment of the present disclosure.

FIG. 9 is a schematic structural diagram of a decoding apparatus 900 according to an embodiment of the present disclosure. The decoding apparatus 900 includes a processor 910, a memory 920, and a communications bus 930.

The processor 910 is conFigured to invoke, by using the communications bus 930, code stored in the memory 920, to synthesize, in a case in which it is determined that a current frame is a lost frame, a high frequency band signal according to a decoding result of a previous frame of the current frame; determine subframe gains of at least two subframes of the current frame according to subframe gains of subframes of at least one frame previous to the current frame and a gain gradient between the subframes of the at least one frame; determine a global gain of the current frame; and adjust, according to the global gain and the subframe gains of the at least two subframes, the synthesized high frequency band signal to obtain a high frequency band signal of the current frame.

According to this embodiment of the present disclosure, the processor 910 determines a subframe gain of a start subframe of the current frame according to the subframe gains of the subframes of the at least one frame and the gain gradient between the subframes of the at least one frame; and determines a subframe gain of another subframe except for the start subframe in the at least two subframes according to the subframe gain of the start subframe of the current frame and the gain gradient between the subframes of the at least one frame.

According to this embodiment of the present disclosure, the processor 910 estimates a first gain gradient between a last subframe of the previous frame of the current frame and the start subframe of the current frame according to a gain gradient between subframes of the previous frame of the current frame; estimates the subframe gain of the start subframe of the current frame according to a subframe gain of the last subframe of the previous frame of the current frame and the first gain gradient; estimates a gain gradient between the at least two subframes of the current frame according to the gain gradient between the subframes of the at least one frame; and estimates the subframe gain of the another subframe except for the start subframe in the at least two subframes according to the gain gradient between the at least two subframes of the current frame and the subframe gain of the start subframe of the current frame.

According to this embodiment of the present disclosure, the processor 910 performs weighted averaging on a gain gradient between at least two subframes of the previous frame of the current frame, to obtain the first gain gradient, and estimates the subframe gain of the start subframe of the current frame according to the subframe gain of the last subframe of the previous frame of the current frame and the first gain gradient, and the frame class of the last frame received before the current frame and the quantity of consecutive lost frames previous to the current frame, where when the weighted averaging is performed, a gain gradient between subframes of the previous frame of the current frame that are closer to the current frame occupies a larger weight.

According to this embodiment of the present disclosure, when the previous frame of the current frame is an $(n-1)^{th}$ frame, the current frame is an $n^{th}$ frame, and each frame includes I subframes, the first gain gradient is obtained by using the following formula:

$$GainGradFEC[0]=\sum_{j=0}^{I-2} GainGrad[n-1, j]*\alpha_j,$$

where GainGradFEC[0] is the first gain gradient, GainGrad [n−1,j] is a gain gradient between a $j^{th}$ subframe and a $(j+1)^{th}$ subframe of the previous frame of the current frame, $\alpha_{j+1}\leq\alpha_j$, $$\sum_{j=0}^{I-2}\alpha_j=1,$$

and j=0, 1, 2, . . . , I−2, where the subframe gain of the start subframe is obtained by using the following formulas:

$$GainShapeTemp[n,0]=GainShape[n-1,I-1]+\varphi_1*GainGradFEC[0];$$

and $$GainShape[n,0]=GainShapeTemp[n,0]*\varphi_2;$$

where GainShape[n−1,I−1] is a subframe gain of an $(I-1)^{th}$ subframe of the $(n-1)^{th}$ frame, GainShape[n,0] is the subframe gain of the start subframe of the current frame, GainShapeTemp[n,0] is a subframe gain intermediate value of the start subframe, $0\leq\varphi_1\leq1.0$, $0<\varphi_2\leq1.0$, $\varphi_1$ is determined by using a frame class of a last frame received before the current frame and a plus or minus sign of the first gain gradient, and $\varphi_2$ is determined by using the frame class of the last frame received before the current frame and a quantity of consecutive lost frames previous to the current frame.

According to this embodiment of the present disclosure, the processor 910 uses a gain gradient, between a subframe previous to the last subframe of the previous frame of the current frame and the last subframe of the previous frame of the current frame, as the first gain gradient; and estimates the subframe gain of the start subframe of the current frame according to the subframe gain of the last subframe of the previous frame of the current frame and the first gain gradient, and the frame class of the last frame received before the current frame and the quantity of consecutive lost frames previous to the current frame.

According to this embodiment of the present disclosure, when the previous frame of the current frame is an $(n-1)^{th}$ frame, the current frame is an $n^{th}$ frame, and each frame includes I subframes, the first gain gradient is obtained by using the following formula: GainGradFEC[0]=GainGrad[n−1,I−2], where GainGradFEC[0] is the first gain gradient, GainGrad[n−1,I−2] is a gain gradient between an $(I-2)^{th}$ subframe and an $(I-1)^{th}$ subframe of the previous frame of the current frame, where the subframe gain of the start subframe is obtained by using the following formulas:

$$GainShapeTemp[n,0]=GainShape[n-1,I-1]+\lambda_1*GainGradFEC[0];$$

$$GainShapeTemp[n,0]=\min(\lambda_2*GainShape[n-1,I-1],GainShapeTemp[n,0]);$$

and $$GainShape[n,0]=\max(\lambda_3*GainShape[n-1,I-1],GainShapeTemp[n,0]);$$

where GainShape[n−1,I−1] is a subframe gain of the $(I-1)^{th}$ subframe of the previous frame of the current frame, GainShape[n,0] is the subframe gain of the start subframe, GainShapeTemp[n,0] is a subframe gain intermediate value of the start subframe, $0<\lambda_1<1.0$, $1<\lambda_2<2$, $0<\lambda_3<1.0$, $\lambda_1$ is determined by using a frame class of a last frame received before the current frame and a multiple relationship between subframe gains of last two subframes of the previous frame of the current frame, and $\lambda_2$ and $\lambda_3$ are determined by using the frame class of the last frame received before the current frame and a quantity of consecutive lost frames previous to the current frame.

According to this embodiment of the present disclosure, each frame includes I subframes, the processor 910 performs weighted averaging on a gain gradient between an $i^{th}$ subframe and an $(i+1)^{th}$ subframe of the previous frame of the current frame and a gain gradient between an $i^{th}$ subframe and an $(i+1)^{th}$ subframe of a previous frame of the previous frame of the current frame, and estimates a gain gradient between an $i^{th}$ subframe and an $(i+1)^{th}$ subframe of the current frame, where i=0, 1, . . . , I−2, and a weight occupied by the gain gradient between the $i^{th}$ subframe and the $(i+1)^{th}$ subframe of the previous frame of the current frame is greater than a weight occupied by the gain gradient between the $i^{th}$ subframe and the $(i+1)^{th}$ subframe of the previous frame of the previous frame of the current frame; and estimates the subframe gain of the another subframe except for the start subframe in the at least two subframes according to the gain gradient between the at least two subframes of the current frame and the subframe gain of the start subframe of the current frame, and the frame class of the last frame received before the current frame and the quantity of consecutive lost frames previous to the current frame.

According to this embodiment of the present disclosure, the gain gradient between the at least two subframes of the current frame is determined by using the following formula:

$$GainGradFEC[i+1]=GainGrad[n-2,i]*\beta_1+GainGrad[n-1,i]*\beta_2,$$

where GainGradFEC[i+1] is a gain gradient between an $i^{th}$ subframe and an $(i+1)^{th}$ subframe, GainGrad[n−2,i] is the gain gradient between the $i^{th}$ subframe and the $(i+1)^{th}$ subframe of the previous frame of the previous frame of the current frame, GainGrad[n−1,i] is the gain gradient between the $i^{th}$ subframe and the $(i+1)^{th}$ subframe of the previous frame of the current frame, $\beta_2>\beta_1$, $\beta_2+\beta_1=1.0$, and i=0, 1, 2, . . . , I−2, where the subframe gain of the another subframe except for the start subframe in the at least two subframes is determined by using the following formulas:

$$GainShapeTemp[n,i]=GainShapeTemp[n,i-1]+GainGradFEC[i]*\beta_3;$$

and $$GainShape[n,i]=GainShapeTemp[n,i]*\beta_4;$$

where GainShape[n,i] is a subframe gain of an $i^{th}$ subframe of the current frame, GainShapeTemp[n,i] is a subframe gain intermediate value of the $i^{th}$ subframe of the current frame, $0\leq\beta_3\leq1.0$, $0<\beta_4\leq1.0$, $\beta_3$ is determined by using a multiple relationship between GainGrad[n−1,i] and GainGrad[n−1,i+1] and a plus or minus sign of GainGrad[n−1,i+1], and $\beta_4$ is determined by using the frame class of the last frame received before the current frame and the quantity of consecutive lost frames previous to the current frame.

According to this embodiment of the present disclosure, the processor 910 performs weighted averaging on I gain gradients between (I+1) subframes previous to an $i^{th}$ subframe of the current frame, and estimates a gain gradient between an $i^{th}$ subframe and an $(i+1)^{th}$ subframe of the current frame, where i=0, 1, . . . , I−2, and a gain gradient between subframes that are closer to the $i^{th}$ subframe occupies a larger weight, and estimates the subframe gain of the another subframe except for the start subframe in the at least two subframes according to the gain gradient between the at least two subframes of the current frame and the subframe gain of the start subframe of the current frame, and the frame class of the last frame received before the current frame and the quantity of consecutive lost frames previous to the current frame.

According to this embodiment of the present disclosure, when the previous frame of the current frame is an $(n-1)^{th}$ frame, the current frame is an $n^{th}$ frame, and each frame includes four subframes, the gain gradient between the at least two subframes of the current frame is determined by using the following formulas:

$$GainGradFEC[1]=GainGrad[n-1,0]*\gamma_1+GainGrad[n-1,1]*\gamma_2+GainGrad[n-1,2]*\gamma_3+GainGradFEC[0]*\gamma_4;$$

$$GainGradFEC[2]=GainGrad[n-1,1]*\gamma_1+GainGrad[n-1,2]*\gamma_2+GainGradFEC[0]*\gamma_3+GainGradFEC[1]*\gamma_4;$$

and $$GainGradFEC[3]=GainGrad[n-1,2]*\gamma_1+GainGradFEC[0]*\gamma_2+GainGradFEC[1]*\gamma_3+GainGradFEC[2]*\gamma_4;$$

where GainGradFEC[j] is a gain gradient between a $j^{th}$ subframe and a $(j+1)^{th}$ subframe of the current frame, GrainGrad[n−1,j] is a gain gradient between a $j^{th}$ subframe and a $(j+1)^{th}$ subframe of the previous frame of the current frame, j=0, 1, 2, . . . , I−2, $\gamma_1+\gamma_2+\gamma_3+\gamma_4=1.0$, and $\gamma_4>\gamma_3>\gamma_2>\gamma_1$, where $\gamma_1$, $\gamma_2$, $\gamma_3$, and $\gamma_4$ are determined by using the frame class of the received last frame, where the subframe gain of the another subframe except for the start subframe in the at least two subframes is determined by using the following formulas:

$$GainShapeTemp[n,i]=GainShapeTemp[n,i-1]+GainGradFEC[i],$$

where i=1, 2, 3, and GainShapeTemp[n,0] is the first gain gradient;

$$GainShapeTemp[n,i]=\min(\gamma_5*GainShape[n-1,i],GainShapeTemp[n,i]);$$

and $$GainShape[n,i]=\max(\gamma_6*GainShape[n-1,i],GainShapeTemp[n,i]);$$

where GainShapeTemp[n,i] is a subframe gain intermediate value of the $i^{th}$ subframe of the current frame, i=1, 2, 3, GainShape[n,i] is a subframe gain of the $i^{th}$ subframe of the current frame, $\gamma_5$ and $\gamma_6$ are determined by using the frame class of the received last frame and the quantity of consecutive lost frames previous to the current frame, $1<\gamma_5<2$, and $0\leq\gamma_6\leq1$.

According to this embodiment of the present disclosure, the processor 910 estimates a global gain gradient of the current frame according to the frame class of the last frame received before the current frame and the quantity of consecutive lost frames previous to the current frame; and estimates the global gain of the current frame according to the global gain gradient and a global gain of the previous frame of the current frame.

According to this embodiment of the present disclosure, the global gain of the current frame is determined by using the following formula: GainFrame=GainFrame_prevfrm*GainAtten, where GainFrame is the global gain of the current frame, GainFrame_prevfrm is the global gain of the previous frame of the current frame, 0<GainAtten≤1.0, GainAtten is the global gain gradient, and GainAtten is determined by using the frame class of the received last frame and the quantity of consecutive lost frames previous to the current frame.

Figure 10:
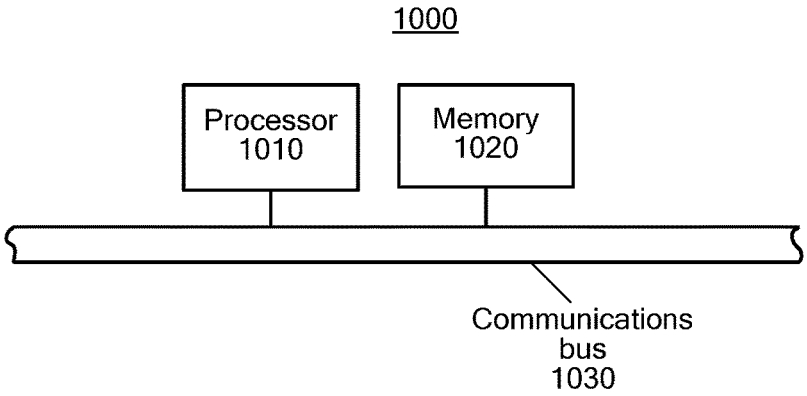
FIG. 10 is a schematic structural diagram of a decoding apparatus according to an embodiment of the present disclosure.

FIG. 10 is a schematic structural diagram of a decoding apparatus 1000 according to an embodiment of the present disclosure. The decoding apparatus 1000 includes a processor 1010, a memory 1020, and a communications bus 1030.

The processor 1010 is conFigured to invoke, by using the communications bus 1030, code stored in the memory 1020, to synthesize, in a case in which it is determined that a current frame is a lost frame, a high frequency band signal according to a decoding result of a previous frame of the current frame; determine subframe gains of at least two subframes of the current frame; estimating a global gain gradient of the current frame according to a frame class of a last frame received before the current frame and a quantity of consecutive lost frames previous to the current frame; estimate a global gain of the current frame according to the global gain gradient and a global gain of the previous frame of the current frame; and adjust, according to the global gain and the subframe gains of the at least two subframes, the synthesized high frequency band signal to obtain a high frequency band signal of the current frame.

According to this embodiment of the present disclosure, GainFrame=GainFrame_prevfrm*GainAtten, where GainFrame is the global gain of the current frame, GainFrame_prevfrm is the global gain of the previous frame of the current frame, 0<GainAtten≤1.0, GainAtten is the global gain gradient, and GainAtten is determined by using the frame class of the received last frame and the quantity of consecutive lost frames previous to the current frame.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present disclosure.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present disclosure may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present disclosure essentially, or the part contributing to the prior art, or some of the technical solutions may be implemented in a form of a software product. The computer software product is stored in a storage medium, and includes several instructions for instructing a computer device (which may be a personal computer, a server, or a network device) to perform all or some of the steps of the methods described in the embodiments of the present disclosure. The foregoing storage medium includes: any medium that can store program code, such as a USB flash drive, a removable hard disk, a read-only memory (ROM, Read-Only Memory), a random access memory (RAM, Random Access Memory), a magnetic disk, or an optical disc.

According to a first aspect, a decoding method is provided, where the method includes: in a case in which it is determined that a current frame is a lost frame, synthesizing a high frequency band signal according to a decoding result of a previous frame of the current frame; determining subframe gains of at least two subframes of the current frame according to subframe gains of subframes of at least one frame previous to the current frame and a gain gradient between the subframes of the at least one frame; determining a global gain of the current frame; and adjusting, according to the global gain and the subframe gains of the at least two subframes, the synthesized high frequency band signal to obtain a high frequency band signal of the current frame.

With reference to the first aspect, in a first possible implementation manner, the determining subframe gains of at least two subframes of the current frame according to subframe gains of subframes of at least one frame previous to the current frame and a gain gradient between the subframes of the at least one frame includes: determining a subframe gain of a start subframe of the current frame according to the subframe gains of the subframes of the at least one frame and the gain gradient between the subframes of the at least one frame; and determining a subframe gain of another subframe except for the start subframe in the at least two subframes according to the subframe gain of the start subframe of the current frame and the gain gradient between the subframes of the at least one frame.

With reference to the first possible implementation manner, in a second possible implementation manner, the determining a subframe gain of a start subframe of the current frame according to the subframe gains of the subframes of the at least one frame and the gain gradient between the subframes of the at least one frame includes: estimating a first gain gradient between a last subframe of the previous frame of the current frame and the start subframe of the current frame according to a gain gradient between subframes of the previous frame of the current frame; and estimating the subframe gain of the start subframe of the current frame according to a subframe gain of the last subframe of the previous frame of the current frame and the first gain gradient.

With reference to the second possible implementation manner, in a third possible implementation manner, the estimating a first gain gradient between a last subframe of the previous frame of the current frame and the start subframe of the current frame according to a gain gradient between subframes of the previous frame of the current frame includes: performing weighted averaging on a gain gradient between at least two subframes of the previous frame of the current frame, to obtain the first gain gradient, where when the weighted averaging is performed, a gain gradient between subframes of the previous frame of the current frame that are closer to the current frame occupies a larger weight.

With reference to the second possible implementation manner or the third possible implementation manner, when the previous frame of the current frame is an $(n-1)^{th}$ frame, the current frame is an $n^{th}$ frame, and each frame includes I subframes, the first gain gradient is obtained by using the following formula:

$$GainGradFEC[0] = \sum_{j=0}^{I-2} GainGrad[n-1, j] * \alpha_j,$$

where GainGradFEC[0] is the first gain gradient, GainGrad[n−1,j] is a gain gradient between a $j^{th}$ subframe and a $(j+1)^{th}$ subframe of the previous frame of the current frame, $\alpha_{j+1} \geq \alpha_j$, $$\sum_{j=0}^{I-2} \alpha_j = 1,$$

and j=0, 1, 2, . . . , I−2, where the subframe gain of the start subframe is obtained by using the following formulas:

$$GainShapeTemp[n,0]=GainShape[n-1,I-1]+\varphi_1*GainGradFEC[0];$$

and $$GainShape[n,0]=GainShapeTemp[n,0]*\varphi_2;$$

where GainShape[n−1,I−1] is a subframe gain of an $(I-1)^{th}$ subframe of the $(n-1)^{th}$ frame, GainShape[n,0] is the subframe gain of the start subframe of the current frame, GainShapeTemp[n,0] is a subframe gain intermediate value of the start subframe, $0 \leq \varphi_1 \leq 1.0$, $0 < \varphi_2 \leq 1.0$, $\varphi_1$ is determined by using a frame class of a last frame received before the current frame and a plus or minus sign of the first gain gradient, and $\varphi_2$ is determined by using the frame class of the last frame received before the current frame and a quantity of consecutive lost frames previous to the current frame.

With reference to the second possible implementation manner, in a fifth possible implementation manner, the estimating a first gain gradient between a last subframe of the previous frame of the current frame and the start subframe of the current frame according to a gain gradient between subframes of the previous frame of the current frame includes: using a gain gradient, between a subframe previous to the last subframe of the previous frame of the current frame and the last subframe of the previous frame of the current frame, as the first gain gradient.

With reference to the second or the fifth possible implementation manner, in a sixth possible implementation manner, when the previous frame of the current frame is an $(n-1)^{th}$ frame, the current frame is an $n^{th}$ frame, and each frame includes I subframes, the first gain gradient is obtained by using the following formula: GainGradFEC[0]=GainGrad[n−1,I−2], where GainGradFEC[0] is the first gain gradient, GainGrad[n−1,I−2] is a gain gradient between an $(I-2)^{th}$ subframe and an $(I-1)^{th}$ subframe of the previous frame of the current frame, where the subframe gain of the start subframe is obtained by using the following formulas:

$$GainShapeTemp[n,0]=GainShape[n-1,I-1]+\lambda_1*GainGradFEC[0];$$

$$GainShapeTemp[n,0]=\min(\lambda_2*GainShape[n-1,I-1], GainShapeTemp[n,0]);$$

and $$GainShape[n,0]=\max(\lambda_3*GainShape[n-1,I-1],GainShapeTemp[n,0]);$$

where GainShape[n−1,I−1] is a subframe gain of the $(I-1)^{th}$ subframe of the previous frame of the current frame, GainShape[n,0] is the subframe gain of the start subframe, GainShapeTemp[n,0] is a subframe gain intermediate value of the start subframe, $0<\lambda_1<1.0$, $1<\lambda_2<2$, $0<\lambda_3<1.0$, $\lambda_1$ is determined by using a frame class of a last frame received before the current frame and a multiple relationship between subframe gains of last two subframes of the previous frame of the current frame, and $\lambda_2$ and $\lambda_3$ are determined by using the frame class of the last frame received before the current frame and a quantity of consecutive lost frames previous to the current frame.

With reference to any one of the second to the sixth possible implementation manners, in a seventh possible implementation manner, the estimating the subframe gain of the start subframe of the current frame according to a subframe gain of the last subframe of the previous frame of the current frame and the first gain gradient includes: estimating the subframe gain of the start subframe of the current frame according to the subframe gain of the last subframe of the previous frame of the current frame and the first gain gradient, and the frame class of the last frame received before the current frame and the quantity of consecutive lost frames previous to the current frame.

With reference to any one of the first to the seventh possible implementation manners, in an eighth possible implementation manner, the determining a subframe gain of another subframe except for the start subframe in the at least two subframes according to the subframe gain of the start subframe of the current frame and the gain gradient between the subframes of the at least one frame includes: estimating a gain gradient between the at least two subframes of the current frame according to the gain gradient between the subframes of the at least one frame; and estimating the subframe gain of the another subframe except for the start subframe in the at least two subframes according to the gain gradient between the at least two subframes of the current frame and the subframe gain of the start subframe of the current frame.

With reference to the eighth possible implementation manner, in a ninth possible implementation manner, each frame includes I subframes, and the estimating a gain gradient between the at least two subframes of the current frame according to the gain gradient between the subframes of the at least one frame includes: performing weighted averaging on a gain gradient between an $i^{th}$ subframe and an $(i+1)^{th}$ subframe of the previous frame of the current frame and a gain gradient between an $i^{th}$ subframe and an $(i+1)^{th}$ subframe of a previous frame of the previous frame of the current frame, and estimating a gain gradient between an $i^{th}$ subframe and an $(i+1)^{th}$ subframe of the current frame, where i=0, 1, . . . , I−2, and a weight occupied by the gain gradient between the $i^{th}$ subframe and the $(i+1)^{th}$ subframe of the previous frame of the current frame is greater than a weight occupied by the gain gradient between the $i^{th}$ subframe and the $(i+1)^{th}$ subframe of the previous frame of the previous frame of the previous frame of the current frame.

With reference to the eighth or the ninth possible implementation manner, in a tenth possible implementation manner, when the previous frame of the current frame is the $(n-1)^{th}$ frame, and the current frame is the $n^{th}$ frame, the gain gradient between the at least two subframes of the current frame is determined by using the following formula:

$$GainGradFEC[i+]=GainGrad[n-2,i]*\beta_1+GainGrad[n-1,i]*\beta_2,$$

where GainGradFEC[i+1] is a gain gradient between an $i^{th}$ subframe and an $(i+1)^{th}$ subframe, GainGrad[n−2,i] is the gain gradient between the $i^{th}$ subframe and the $(i+1)^{th}$ subframe of the previous frame of the previous frame of the current frame, GainGrad[n−1,i] is the gain gradient between the $i^{th}$ subframe and the $(i+1)^{th}$ subframe of the previous frame of the current frame, $\beta_2>\beta_1$, $\beta_2+\beta_1=1.0$, and i=0, 1, 2, . . . , I−2, where the subframe gain of the another subframe except for the start subframe in the at least two subframes is determined by using the following formulas:

$$GainShapeTemp[n,i]=GainShapeTemp[n,i-1]+GainGradFEC[i]*\beta_3;\text{ and}$$

$$GainShape[n,i]=GainShapeTemp[n,i]*\beta_4;$$

where GainShape[n,i] is a subframe gain of an $i^{th}$ subframe of the current frame, GainShapeTemp[n,i] is a subframe gain intermediate value of the $i^{th}$ subframe of the current frame, $0\leq\beta_3\leq1.0$, $0<\beta_4\leq1.0$, $\beta_3$ is determined by using a multiple relationship between GainGrad[n−1,i] and GainGrad[n−1,i+1] and a plus or minus sign of GainGrad [n−1,i+1], and $\beta_4$ is determined by using the frame class of the last frame received before the current frame and the quantity of consecutive lost frames previous to the current frame.

With reference to the eighth possible implementation manner, in an eleventh possible implementation manner, each frame includes I subframes, and the estimating a gain gradient between the at least two subframes of the current frame according to the gain gradient between the subframes of the at least one frame includes: performing weighted averaging on I gain gradients between (I+1) subframes previous to an $i^{th}$ subframe of the current frame, and estimating a gain gradient between an $i^{th}$ subframe and an $(i+1)^{th}$ subframe of the current frame, where i=0, 1, . . . , I−2, and a gain gradient between subframes that are closer to the $i^{th}$ subframe occupies a larger weight.

With reference to the eighth or the eleventh possible implementation manner, in a twelfth possible implementation manner, when the previous frame of the current frame is the $(n-1)^{th}$ frame, the current frame is the $n^{th}$ frame, and each frame includes four subframes, the gain gradient between the at least two subframes of the current frame is determined by using the following formulas:

$$GainGradFEC[1]=GainGrad[n-1,0]*\gamma_1+GainGrad[n-1;1]*\gamma_2+GainGrad[n-1,2]*\gamma_3+GainGradFEC[0]*\gamma_4;$$

$$GainGradFEC[2]=GainGrad[n-1,1]*\gamma_1+GainGrad[n-1,2]*\gamma_2+GainGradFEC[0]*\gamma_3+GainGradFEC[1]*\gamma_4;$$

and $$GainGradFEC[3]=GainGrad[n-1,2]*\gamma_1+GainGradFEC[0]*\gamma_2+GainGradFEC[1]*\gamma_3+GainGradFEC[2]*\gamma_4;$$

where GainGradFEC[j] is a gain gradient between a $j^{th}$ subframe and a $(j+1)^{th}$ subframe of the current frame, GainGrad[n−1,j] is a gain gradient between a $j^{th}$ subframe and a $(j+1)^{th}$ subframe of the previous frame of the current frame, j=0, 1, 2, . . . , I−2, $\gamma_1+\gamma_2+\gamma_3+\gamma_4=1.0$, and $\gamma_4>\gamma_3>\gamma_2>\gamma_1$, where $\gamma_1$, $\gamma_2$, $\gamma_3$, and $\gamma_4$ are determined by using the frame class of the received last frame, where the subframe gain of the another subframe except for the start subframe in the at least two subframes is determined by using the following formulas:

$$GainShapeTemp[n,i]=GainShapeTemp[n,i-1]+GainGradFEC[i],$$

where i=1, 2, 3, and GainShapeTemp[n,0] is the first gain gradient;

$$GainShapeTemp[n,i]=\min(\gamma_5*GainShape[n-1,i],GainShapeTemp[n,i]);$$

and $$GainShape[n,i]=\max(\gamma_6*GainShape[n-1,i],GainShapeTemp[n,i]);$$

where i=1, 2, 3, GainShapeTemp[n,i] is a subframe gain intermediate value of the $i^{th}$ subframe of the current frame, GainShape[n,i] is a subframe gain of the $i^{th}$ subframe of the current frame, $\gamma_5$ and $\gamma_6$ are determined by using the frame class of the received last frame and the quantity of consecutive lost frames previous to the current frame, $1<\gamma_5<2$, and $0\leq\gamma_6\leq1$.

With reference to any one of the eighth to the twelfth possible implementation manners, in a thirteenth possible implementation manner, the estimating the subframe gain of the another subframe except for the start subframe in the at least two subframes according to the gain gradient between the at least two subframes of the current frame and the subframe gain of the start subframe of the current frame includes: estimating the subframe gain of the another subframe except for the start subframe in the at least two subframes according to the gain gradient between the at least two subframes of the current frame and the subframe gain of the start subframe of the current frame, and the frame class of the last frame received before the current frame and the quantity of consecutive lost frames previous to the current frame.

With reference to the first aspect or any one of the foregoing possible implementation manners, in a fourteenth possible implementation manner, the estimating a global gain of the current frame includes: estimating a global gain gradient of the current frame according to the frame class of the last frame received before the current frame and the quantity of consecutive lost frames previous to the current frame; and estimating the global gain of the current frame according to the global gain gradient and a global gain of the previous frame of the current frame.

With reference to the fourteenth possible implementation manner, in a fifteenth possible implementation manner, the global gain of the current frame is determined by using the following formula: GainFrame=GainFrame_prevfrm*GainAtten, where GainFrame is the global gain of the current frame, GainFrame_prevfrm is the global gain of the previous frame of the current frame, 0<GainAtten≤1.0, GainAtten is the global gain gradient, and GainAtten is determined by using the frame class of the received last frame and the quantity of consecutive lost frames previous to the current frame.

According to a second aspect, a decoding method is provided, where the method includes: in a case in which it is determined that a current frame is a lost frame, synthesizing a high frequency band signal according to a decoding result of a previous frame of the current frame; determining subframe gains of at least two subframes of the current frame; estimating a global gain gradient of the current frame according to a frame class of a last frame received before the current frame and a quantity of consecutive lost frames previous to the current frame; estimating a global gain of the current frame according to the global gain gradient and a global gain of the previous frame of the current frame; and adjusting, according to the global gain and the subframe gains of the at least two subframes, the synthesized high frequency band signal to obtain a high frequency band signal of the current frame.

With reference to the second aspect, in a first possible implementation manner, the global gain of the current frame is determined by using the following formula: GainFrame=GainFrame_prevfrm*GainAtten, where GainFrame is the global gain of the current frame, GainFrame_prevfrm is the global gain of the previous frame of the current frame, 0<GainAtten≤1.0, GainAtten is the global gain gradient, and GainAtten is determined by using the frame class of the received last frame and the quantity of consecutive lost frames previous to the current frame.

According to a third aspect, a decoding apparatus is provided, where the apparatus includes: a generating module, conFigured to: in a case in which it is determined that a current frame is a lost frame, synthesize a high frequency band signal according to a decoding result of a previous frame of the current frame; a determining module, conFigured to determine subframe gains of at least two subframes of the current frame according to subframe gains of subframes of at least one frame previous to the current frame and a gain gradient between the subframes of the at least one frame, and determine a global gain of the current frame; and an adjusting module, conFigured to adjust, according to the global gain and the subframe gains of the at least two subframes that are determined by the determining module, the synthesized high frequency band signal synthesized by the generating module, to obtain a high frequency band signal of the current frame.

With reference to the third aspect, in a first possible implementation manner, the determining module determines a subframe gain of a start subframe of the current frame according to the subframe gains of the subframes of the at least one frame and the gain gradient between the subframes of the at least one frame, and determines a subframe gain of another subframe except for the start subframe in the at least two subframes according to the subframe gain of the start subframe of the current frame and the gain gradient between the subframes of the at least one frame.

With reference to the first possible implementation manner of the third aspect, in a second possible implementation manner, the determining module estimates a first gain gradient between a last subframe of the previous frame of the current frame and the start subframe of the current frame according to a gain gradient between subframes of the previous frame of the current frame, and estimates the subframe gain of the start subframe of the current frame according to a subframe gain of the last subframe of the previous frame of the current frame and the first gain gradient.

With reference to the second possible implementation manner of the third aspect, in a third possible implementation manner, the determining module performs weighted averaging on a gain gradient between at least two subframes of the previous frame of the current frame, to obtain the first gain gradient, where when the weighted averaging is performed, a gain gradient between subframes of the previous frame of the current frame that are closer to the current frame occupies a larger weight.

With reference to the first possible implementation manner of the third aspect or the second possible implementation manner of the third aspect, in a fourth possible implementation manner, when the previous frame of the current frame is an $(n-1)^{th}$ frame, the current frame is an $n^{th}$ frame, and each frame includes I subframes, the first gain gradient is obtained by using the following formula:

$$GainGradFEC[0] = \sum_{j=0}^{I-2} GainGrad[n-1, j] * \alpha_j,$$

where GainGradFEC[0] is the first gain gradient, GainGrad[n−1,j] is a gain gradient between a $j^{th}$ subframe and a $(j+1)^{th}$ subframe of the previous frame of the current frame, $\alpha_{j+1} \geq \alpha_j$, $$\sum_{j=0}^{I-2} \alpha_j = 1,$$

and j=0, 1, 2, . . . , I−2, where the subframe gain of the start subframe is obtained by using the following formulas:

$$GainShapeTemp[n,0]=GainShape[n-1,I-1]+\varphi_1*GainGradFEC[0];$$

and $$GainShape[n,0]=GainShapeTemp[n,0]*\varphi_2;$$

where GainShape[n−1,I−1] is a subframe gain of an $(I-1)^{th}$ subframe of the $(n-1)^{th}$ frame, GainShape[n,0] is the subframe gain of the start subframe of the current frame, GainShapeTemp[n,0] is a subframe gain intermediate value of the start subframe, $0 \leq \varphi_1 \leq 1.0$, $0 < \varphi_2 \leq 1.0$, $\varphi_1$ is determined by using a frame class of a last frame received before the current frame and a plus or minus sign of the first gain gradient, and $\varphi_2$ is determined by using the frame class of the last frame received before the current frame and a quantity of consecutive lost frames previous to the current frame.

With reference to the second possible implementation manner of the third aspect, in a fifth possible implementation manner, the determining module uses a gain gradient, between a subframe previous to the last subframe of the previous frame of the current frame and the last subframe of the previous frame of the current frame, as the first gain gradient.

With reference to the second or the fifth possible implementation manner of the third aspect, in a sixth possible implementation manner, when the previous frame of the current frame is an $(n-1)^{th}$ frame, the current frame is an $n^{th}$ frame, and each frame includes I subframes, the first gain gradient is obtained by using the following formula: GainGradFEC[0]=GainGrad[n−1,I−2] where GainGradFEC[0] is the first gain gradient, GainGrad[n−1,I−2] is a gain gradient between an $(I-2)^{th}$ subframe and an $(I-1)^{th}$ subframe of the previous frame of the current frame, where the subframe gain of the start subframe is obtained by using the following formulas:

$$GainShapeTemp[n,0]=GainShape[n-1,I-1]+\lambda_1*GainGradFEC[0];$$

$$GainShapeTemp[n,0]=\min(\lambda_2*GainShape[n-1,I-1], GainShapeTemp[n,0]);$$

and $$GainShape[n,0]=\max(\lambda_3*GainShape[n-1,I-1], GainShapeTemp[n,0]);$$

where GainShape[n−1,I−1] is a subframe gain of the $(I-1)^{th}$ subframe of the previous frame of the current frame, GainShape[n,0] is the subframe gain of the start subframe, GainShapeTemp[n,0] is a subframe gain intermediate value of the start subframe, $0<\lambda_1<1.0$, $1<\lambda_2<2$, $0<\lambda_3<1.0$, $\lambda_1$ is determined by using a frame class of a last frame received before the current frame and a multiple relationship between subframe gains of last two subframes of the previous frame of the current frame, and $\lambda_2$ and $\lambda_3$ are determined by using the frame class of the last frame received before the current frame and a quantity of consecutive lost frames previous to the current frame.

With reference to any one of the second to the sixth possible implementation manners of the third aspect, in a seventh possible implementation manner, the determining module estimates the subframe gain of the start subframe of the current frame according to the subframe gain of the last subframe of the previous frame of the current frame and the first gain gradient, and the frame class of the last frame received before the current frame and the quantity of consecutive lost frames previous to the current frame.

With reference to any one of the first to the seventh possible implementation manners of the third aspect, in an eighth possible implementation manner, the determining module estimates a gain gradient between the at least two subframes of the current frame according to the gain gradient between the subframes of the at least one frame, and estimates the subframe gain of the another subframe except for the start subframe in the at least two subframes according to the gain gradient between the at least two subframes of the current frame and the subframe gain of the start subframe of the current frame.

With reference to the eighth possible implementation manner of the third aspect, in a ninth possible implementation manner, each frame includes I subframes, and the determining module performs weighted averaging on a gain gradient between an $i^{th}$ subframe and an $(i+1)^{th}$ subframe of the previous frame of the current frame and a gain gradient between an $i^{th}$ subframe and an $(i+1)^{th}$ subframe of a previous frame of the previous frame of the current frame, and estimates a gain gradient between an $i^{th}$ subframe and an $(i+1)^{th}$ subframe of the current frame, where i=0, 1, . . . , I−2, and a weight occupied by the gain gradient between the $i^{th}$ subframe and the $(i+1)^{th}$ subframe of the previous frame of the current frame is greater than a weight occupied by the gain gradient between the $i^{th}$ subframe and the $(i+1)^{th}$ subframe of the previous frame of the previous frame of the current frame.

With reference to the eighth or the ninth possible implementation manner of the third aspect, in a tenth possible implementation manner, the gain gradient between the at least two subframes of the current frame is determined by using the following formula:

$$GainGradFEC[i+1]=GainGrad[n-2,i]*\beta_1+GainGrad[n-1,i]*\beta_2,$$

where GainGradFEC[i+1] is a gain gradient between an $i^{th}$ subframe and an $(i+1)^{th}$ subframe, GainGrad[n−2,i] is the gain gradient between the $i^{th}$ subframe and the $(i+1)^{th}$ subframe of the previous frame of the previous frame of the current frame, GainGrad[n−1,i] is the gain gradient between the $i^{th}$ subframe and the $(i+1)^{th}$ subframe of the previous frame of the current frame, $\beta_2>\beta_1$, $\beta_2+\beta_1=1.0$, and i=0, 1, 2, . . . , I−2, where the subframe gain of the another subframe except for the start subframe in the at least two subframes is determined by using the following formulas:

$$GainShapeTemp[n,i]=GainShapeTemp[n,i-1]+GainGradFEC[i]*\beta_3;$$

and $$GainShape[n,i]=GainShapeTemp[n,i]*\beta_4;$$

where GainShape[n,i] is a subframe gain of an $i^{th}$ subframe of the current frame, GainShapeTemp[n,i] is a subframe gain intermediate value of the $i^{th}$ subframe of the current frame, $0\leq\beta_3\leq1.0$, $0<\beta_4\leq1.0$, $\beta_3$ is determined by using a multiple relationship between GainGrad[n−1,i] and GainGrad[n−1,i+1] and a plus or minus sign of GainGrad [n−1,i+1], and $\beta_4$ is determined by using the frame class of the last frame received before the current frame and the quantity of consecutive lost frames previous to the current frame.

With reference to the eighth possible implementation manner of the third aspect, in an eleventh possible implementation manner, the determining module performs weighted averaging on I gain gradients between (I+1) subframes previous to an $i^{th}$ subframe of the current frame, and estimates a gain gradient between an $i^{th}$ subframe and an $(i+1)^{th}$ subframe of the current frame, where i=0, 1, . . . , I−2, and a gain gradient between subframes that are closer to the $i^{th}$ subframe occupies a larger weight.

With reference to the eighth or the eleventh possible implementation manner of the third aspect, in a twelfth possible implementation manner, when the previous frame of the current frame is the $(n-1)^{th}$ frame, the current frame is the $n^{th}$ frame, and each frame includes four subframes, the gain gradient between the at least two subframes of the current frame is determined by using the following formulas:

$$GainGradFEC[1]=GainGrad[n-1,0]*\gamma_1+GainGrad[n-1,1]*\gamma_2+GainGrad[n-1,2]*\gamma_3+GainGradFEC[0]*\gamma_4;$$

$$GainGradFEC[2]=GainGrad[n-1,1]*\gamma_1+GainGrad[n-1,2]*\gamma_2+GainGradFEC[0]*\gamma_3+GainGradFEC[1]*\gamma_4;$$

and $$GainGradFEC[3]=GainGrad[n-1,2]*\gamma_1+GainGradFEC[0]*\gamma_2+GainGradFEC[1]*\gamma_3+GainGradFEC[2]*\gamma_4;$$

where GainGradFEC[j] is a gain gradient between a $j^{th}$ subframe and a $(j+1)^{th}$ subframe of the current frame, GainGrad[n−1,j] is a gain gradient between a $j^{th}$ subframe and a $(j+1)^{th}$ subframe of the previous frame of the current frame, j=0, 1, 2, . . . , I−2, $\gamma_1+\gamma_2+\gamma_3+\gamma_4=1.0$, and $\gamma_4>\gamma_3>\gamma_2>\gamma_1$, where $\gamma_1$, $\gamma_2$, $\gamma_3$, and $\gamma_4$ are determined by using the frame class of the received last frame, where the subframe gain of the another subframe except for the start subframe in the at least two subframes is determined by using the following formulas:

$$GainShapeTemp[n,i]=GainShapeTemp[n,i-1]+GainGradFEC[i],$$

where i=1, 2, 3, and GainShapeTemp[n,0] is the first gain gradient;

$$GainShapeTemp[n,i]=\min(\gamma_5*GainShape[n-1,i],GainShapeTemp[n,i]);$$

and $$GainShape[n,i]=\max(\gamma_6*GainShape[n-1,i],GainShapeTemp[n,i]);$$

where GainShapeTemp[n,i] is a subframe gain intermediate value of the $i^{th}$ subframe of the current frame, i=1, 2, 3, GainShape[n,i] is a subframe gain of the $i^{th}$ subframe of the current frame, $\gamma_5$ and $\gamma_6$ are determined by using the frame class of the received last frame and the quantity of consecutive lost frames previous to the current frame, $1<\gamma_5<2$, and $0\leq\gamma_6\leq1$.

With reference to any one of the eighth to the twelfth possible implementation manners, in a thirteenth possible implementation manner, the determining module estimates the subframe gain of the another subframe except for the start subframe in the at least two subframes according to the gain gradient between the at least two subframes of the current frame and the subframe gain of the start subframe of the current frame, and the frame class of the last frame received before the current frame and the quantity of consecutive lost frames previous to the current frame.

With reference to the third aspect or any one of the foregoing possible implementation manners, in a fourteenth possible implementation manner, the determining module estimates a global gain gradient of the current frame according to the frame class of the last frame received before the current frame and the quantity of consecutive lost frames previous to the current frame; and estimates the global gain of the current frame according to the global gain gradient and a global gain of the previous frame of the current frame.

With reference to the fourteenth possible implementation manner of the third aspect, in a fifteenth possible implementation manner, the global gain of the current frame is determined by using the following formula: GainFrame=GainFrame_prevfrm*GainAtten, where GainFrame is the global gain of the current frame, GainFrame_prevfrm is the global gain of the previous frame of the current frame, 0<GainAtten≤1.0, GainAtten is the global gain gradient, and GainAtten is determined by using the frame class of the received last frame and the quantity of consecutive lost frames previous to the current frame.

According to a fourth aspect, a decoding apparatus is provided, where the apparatus includes: a generating module, conFigured to: in a case in which it is determined that a current frame is a lost frame, synthesize a high frequency band signal according to a decoding result of a previous frame of the current frame; a determining module, conFigured to determine subframe gains of at least two subframes of the current frame, estimate a global gain gradient of the current frame according to a frame class of a last frame received before the current frame and a quantity of consecutive lost frames previous to the current frame, and estimate a global gain of the current frame according to the global gain gradient and a global gain of the previous frame of the current frame; and an adjusting module, conFigured to adjust, according to the global gain and the subframe gains of the at least two subframes that are determined by the determining module, the high frequency band signal synthesized by the generating module, to obtain a high frequency band signal of the current frame.

With reference to the fourth aspect, in a first possible implementation manner, GainFrame=

GainFrame_prevfrm*GainAtten, where GainFrame is the global gain of the current frame, GainFrame_prevfrm is the global gain of the previous frame of the current frame, 0<GainAtten≤1.0, GainAtten is the global gain gradient, and GainAtten is determined by using the frame class of the received last frame and the quantity of consecutive lost frames previous to the current frame.

In the embodiments of the present disclosure, when it is determined that a current frame is a lost frame, subframe gains of subframes of the current frame are determined according to subframe gains of subframes previous to the current frame and a gain gradient between the subframes previous to the current frame, and a high frequency band signal is adjusted by using the determined subframe gains of the current frame. A subframe gain of the current frame is obtained according to a gradient (which is a change trend) between subframe gains of subframes previous to the current frame, so that transition before and after frame loss is more continuous, thereby reducing noise during signal reconstruction, and improving speech quality.

The foregoing descriptions are merely specific implementation manners of the present disclosure, but are not intended to limit the protection scope of the present disclosure. Any variation or replacement readily Figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A decoding method for decoding an audio signal, comprising:

synthesizing a high frequency band signal according to a decoding result of a previous frame of a current frame of the audio signal;

determining a first gain gradient between a last subframe of the previous frame and a start subframe of the current frame according to a gain gradient between subframes of the previous frame of the current frame;

determining the subframe gain of the start subframe of the current frame according to a subframe gain of the last subframe of the previous frame of the current frame and the first gain gradient;

determining a subframe gain of another subframe according to the gain gradient between the subframes of the previous frame of the current frame;

determining a global gain of the current frame;

adjusting, according to the global gain and the subframe gains of the current frame, the synthesized high frequency band signal; and obtaining, based upon the adjustment of the synthesized high frequency band signal, a high frequency band signal of the current frame.

2. The method according to claim 1, wherein the determining the first gain gradient comprises:

performing weighted averaging on a gain gradient between at least two subframes of the previous frame of the current frame, to obtain the first gain gradient, wherein when the weighted averaging is performed, a gain gradient between subframes of the previous frame of the current frame that are closer to the current frame occupies a larger weight.

3. The method according to claim 1, wherein the determining the first gain gradient comprises:

determining a gain gradient using a subframe previous to the last subframe of the previous frame of the current frame and the last subframe of the previous frame of the current frame.

4. The method according to claim 1, wherein the determining a global gain of the current frame comprises:

determining a global gain gradient of the current frame according to the frame class of the last frame received before the current frame and the quantity of consecutive lost frames previous to the current frame; and estimating the global gain of the current frame according to the global gain gradient and a global gain of the previous frame of the current frame.

5. A decoding apparatus used for decoding an audio signal, comprising:

a processor, and a non-transitory computer-readable storage medium coupled to the processor and storing programming instructions for execution by the processor, the programming instructions instruct the processor to:

synthesize a high frequency band signal according to a decoding result of a previous frame of a current frame of the audio signal, determine a first gain gradient between a last subframe of a previous frame and a start subframe of the current frame according to a gain gradient between subframes of the previous frame of the current frame;

determine the subframe gain of the start subframe of the current frame according to a subframe gain of the last subframe of the previous frame of the current frame and the first gain gradient;

determine a subframe gain of another subframe according to the gain gradient between the subframes of the at least one frame previous to the current frame;

determine a global gain of the current frame, and adjust, according to the global gain and the subframe gains of the current frame, the high frequency band signal, to obtain a high frequency band signal of the current frame.

6. The decoding apparatus according to claim 5, wherein the programming instructions instruct the processor to:

perform weighted averaging on a gain gradient between at least two subframes of the previous frame of the current frame to obtain the first gain gradient, wherein when the weighted averaging is performed, a gain gradient between subframes of the previous frame of the current frame that are closer to the current frame occupies a larger weight.

7. The decoding apparatus according to claim 5, wherein the programming instructions instruct the processor to:

use a gain gradient, between a subframe previous to the last subframe of the previous frame of the current frame and the last subframe of the previous frame of the current frame, as the first gain gradient.

8. The decoding apparatus according to claim 5, wherein the subframe gain of the start subframe of the current frame is estimated according to the subframe gain of the last subframe of the previous frame of the current frame and the first gain gradient, and the frame class of the last frame received before the current frame and the quantity of consecutive lost frames previous to the current frame.

9. The decoding apparatus according to claim 8, wherein a GainFrame=GainFrame_prevfrm*GainAtten, wherein GainFrame is the global gain of the current frame, GainFrame_prevfrm is the global gain of the previous frame of the current frame, 0<GainAtten≤1.0, GainAtten is the global gain gradient, and GainAtten is determined by using the frame class of the received last frame and the quantity of consecutive lost frames previous to the current frame.

10. The decoding apparatus according to claim 5, wherein a gain gradient between the at least two subframes of the current frame is estimated according to the gain gradient between the subframes of the at least one frame, and the subframe gain of the another subframe except for the start subframe in the at least two subframes is estimated according to the gain gradient between the at least two subframes of the current frame and the subframe gain of the start subframe of the current frame.

* * * * *